US012668979B2

(12) United States Patent
Fatcheric

(10) Patent No.: US 12,668,979 B2
(45) Date of Patent: Jun. 30, 2026

(54) PANEL FASTENING DEVICES, SYSTEMS AND RELATED METHODS

(71) Applicant: Jeffrey Fatcheric, Weedsport, NY (US)

(72) Inventor: Jeffrey Fatcheric, Weedsport, NY (US)

( * ) Notice: Subject to any disclaimer, the term of this patent is extended or adjusted under 35 U.S.C. 154(b) by 475 days.

(21) Appl. No.: 18/152,755

(22) Filed: Jan. 10, 2023

(65) Prior Publication Data

US 2023/0167644 A1 Jun. 1, 2023

Related U.S. Application Data

(63) Continuation-in-part of application No. 16/904,328, filed on Jun. 17, 2020, now Pat. No. 11,549,260.

(60) Provisional application No. 62/862,269, filed on Jun. 17, 2019.

(51) Int. Cl.
*E04F 13/08* (2006.01)
*E04B 2/70* (2006.01)

(52) U.S. Cl.
CPC ..... *E04F 13/0882* (2013.01); *E04B 2/707* (2013.01)

(58) Field of Classification Search
CPC ..... E04B 2/707; E04B 2/7409; E04B 2/80; E04B 2002/747; E04F 13/0882
See application file for complete search history.

(56) References Cited

U.S. PATENT DOCUMENTS 1,658,407 A * 2/1928 Gustaveson ..... E04B 2/845 256/49
2,063,010 A * 12/1936 Balduf ..... E04B 2/7818 52/363
2,101,001 A * 11/1937 Balduf ..... E04F 13/045 52/285.3
2,121,962 A * 6/1938 Glass ..... E04B 2/845 181/295
2,430,961 A * 11/1947 Sprunger ..... E04B 1/6141 52/584.1

(Continued)

FOREIGN PATENT DOCUMENTS

JP H05141071 6/1993
WO WO-2016027175 A2 * 2/2016 ..... E06B 3/9682
WO WO-2018146611 A1 * 8/2018 ..... E04H 1/1272

OTHER PUBLICATIONS

Velcro Brand 2015 US Product Line Brochure.

*Primary Examiner* — James M Ference
(74) *Attorney, Agent, or Firm* — Heslin Rothenberg Farley & Mesiti P.C.

(57) ABSTRACT

Framing and panel fastening devices, systems and methods. The fastening devices include an interface portion comprising an inner side and an outer side opposing the inner side, the outer side comprising a first touch fastening component of a touch fastener. The devices further include first and second side wall portions extending in a thickness direction from the inner side of the interface portion. The interface portion extends laterally between the first and second side wall portions to form an inner channel configured to receive and couple to at least a front face portion of a framing member therein. The systems comprise at least one of the fastening devices and at least one building panel with a back face that comprises a second touch fastening component coupled thereto. The first and second touch fastening components configured to removably couple together when operatively engaged.

20 Claims, 14 Drawing Sheets

(56) References Cited

U.S. PATENT DOCUMENTS 3,475,810 A * 11/1969 Mates ..... A44B 18/00 52/DIG. 2
3,721,050 A * 3/1973 Perina ..... E04B 9/24 52/475.1
3,807,112 A * 4/1974 Perina ..... E04B 2/74 52/285.3
3,826,055 A * 7/1974 Bobzin ..... E04F 13/0889 52/483.1
3,852,927 A * 12/1974 Birum, Jr. ..... E04B 2/789 52/489.1
3,859,765 A * 1/1975 Nelsson ..... E04B 2/7854 52/424
3,863,412 A * 2/1975 Bodycomb ..... E04B 2/7457 52/346
3,945,167 A * 3/1976 Wendt ..... E04B 2/62 52/714
3,991,534 A * 11/1976 Brumlik ..... E04B 1/49 24/442
4,011,704 A * 3/1977 O'Konski ..... E04C 3/07 52/481.1
4,041,667 A * 8/1977 Lindner ..... E04B 2/7457 52/309.1
4,068,428 A * 1/1978 Peterson, III ..... E06B 3/28 160/354
4,069,639 A * 1/1978 Lindner ..... E04B 2/7457 52/745.1
4,090,335 A * 5/1978 Curatolo ..... E04B 2/7422 24/442
4,296,580 A * 10/1981 Weinar ..... E04B 2/7457 52/489.2
4,466,225 A * 8/1984 Hovind ..... E04C 3/292 52/855
4,513,551 A * 4/1985 Gauffin ..... E04B 2/789 52/364
4,562,675 A * 1/1986 Baigas, Jr. ..... E06B 3/285 160/354
4,581,865 A * 4/1986 Miller ..... E06B 3/28 52/202
4,720,957 A * 1/1988 Madray ..... E04B 1/24 52/846
4,744,189 A * 5/1988 Wilson ..... B44C 7/022 434/421
4,796,397 A * 1/1989 Capaul ..... E04F 13/088 428/116
4,866,899 A * 9/1989 Houser ..... E04B 2/7863 52/842
4,974,384 A * 12/1990 Pacione ..... E04B 5/04 52/483.1
5,060,443 A * 10/1991 Pacione ..... E04F 15/02138 52/483.1
5,133,166 A * 7/1992 Pacione ..... E04G 11/50 52/250
5,144,786 A * 9/1992 Pacione ..... E04F 15/02138 52/745.1
5,259,163 A * 11/1993 Pacione ..... E04F 13/0882 52/511
5,359,826 A * 11/1994 Grearson ..... E04C 3/07 52/848
5,605,024 A * 2/1997 Sucato ..... E04C 3/32 52/696
5,632,127 A * 5/1997 Agar ..... E04B 2/7453 52/489.2
5,768,849 A * 6/1998 Blazevic ..... E04C 3/07 52/847
5,787,651 A * 8/1998 Horn ..... E04B 2/7412 52/846
5,906,080 A * 5/1999 diGirolamo ..... E04B 2/7453 52/656.1
5,950,386 A * 9/1999 Shipman ..... E04F 11/00 52/239
5,974,753 A * 11/1999 Hsu ..... E04F 13/0862 52/287.1
6,180,205 B1 * 1/2001 Tachauer ..... A44B 18/0049 24/442
6,192,962 B1 * 2/2001 Glover ..... A47H 13/00 160/368.1
6,205,740 B1 * 3/2001 Ekerholm ..... E04C 3/09 52/670
6,751,915 B2 * 6/2004 Crowley ..... E04F 13/10 52/211
7,064,280 B1 * 6/2006 Rodgers ..... H05K 9/0003 174/394
7,866,112 B2 * 1/2011 Edmondson ..... E04C 3/07 52/646
8,074,416 B2 * 12/2011 Andrews ..... E04B 2/767 403/230
8,225,581 B2 * 7/2012 Strickland ..... E04C 3/07 52/855
8,720,141 B2 * 5/2014 Shembekar ..... E04F 13/0801 52/309.8
8,919,064 B2 * 12/2014 Valle ..... E04C 2/06 52/855
8,984,838 B2 3/2015 Bordener
9,140,017 B1 * 9/2015 Oliver ..... E04F 13/081
9,359,771 B1 * 6/2016 Delforte ..... E04F 13/083
9,518,393 B2 12/2016 Bordener
9,624,661 B2 4/2017 Poulakis
9,650,790 B2 * 5/2017 Bordener ..... E04F 13/0803
10,024,056 B2 * 7/2018 Pacione ..... E04F 15/02138
10,208,487 B1 * 2/2019 Kimmerle ..... E04F 13/0882
10,550,580 B1 * 2/2020 Longo ..... E04B 1/86
11,098,494 B2 * 8/2021 Lesage ..... E04H 1/1272
2002/0056243 A1 * 5/2002 Sawada ..... E04F 13/0889 52/396.04
2003/0070391 A1 * 4/2003 Tachauer ..... A44B 18/0049 52/506.05
2003/0074846 A1 * 4/2003 Tollenaar ..... E04B 2/7457 52/125.1
2003/0074849 A1 * 4/2003 Surowiecki ..... E04C 3/07 52/301
2005/0055967 A1 * 3/2005 Kariakin ..... E04C 3/07 52/855
2005/0076600 A1 * 4/2005 Moody ..... E04B 2/58 52/633
2006/0110572 A1 * 5/2006 Herrero ..... A44B 18/0049 264/46.4
2006/0144009 A1 * 7/2006 Attalla ..... E04C 3/11 52/831
2009/0013633 A1 * 1/2009 Aubuchon ..... B21D 13/02 52/634
2009/0205282 A1 * 8/2009 Belsley ..... E04B 2/7453 52/565
2009/0282759 A1 * 11/2009 Porter ..... E04B 2/7457 52/220.1
2010/0050548 A1 * 3/2010 Krieger ..... E04B 2/7453 52/285.3
2010/0146893 A1 * 6/2010 Dickinson ..... E04F 17/00 52/302.3
2012/0011795 A1 * 1/2012 Pacione ..... A47G 27/0475 156/289
2013/0111840 A1 * 5/2013 Bordener ..... E04B 1/68 52/393
2014/0103567 A1 * 4/2014 Collins ..... B29C 43/46 24/451
2015/0191912 A1 * 7/2015 Bordener ..... E04F 13/0826 52/772
2015/0204063 A1 * 7/2015 Poulakis ..... E04C 2/243 24/445
2015/0240486 A1 * 8/2015 Sacks ..... E04C 3/07 52/633
2018/0298617 A1 * 10/2018 Drochon ..... E04F 13/0882
2019/0112819 A1 * 4/2019 Gebhardt ..... E04F 13/0839
2020/0299955 A1 * 9/2020 Ryan ..... E04B 2/707
2020/0392727 A1 * 12/2020 Fatcheric ..... E04F 13/0882
2023/0167644 A1 * 6/2023 Fatcheric ..... E04B 2/7409 52/506.05

* cited by examiner

PANEL FASTENING DEVICES, SYSTEMS AND RELATED METHODS

CROSS-REFERENCE TO RELATED APPLICATION

This application is a continuation-in-part of U.S. patent application Ser. No. 16/904,328, filed Jun. 17, 2020, and entitled Wall Panel Fastening Systems and Methods, which claims priority benefit under 35 U.S.C. § 119(e) of U.S. Provisional Patent Application No. 62/862,269, filed Jun. 17, 2019, and entitled Drywall System and Method, which are incorporated herein by reference in their entireties.

TECHNICAL FIELD

The present disclosure generally relates to building panel (e.g., drywall) installation systems and methods for the installation of building panels on framework.

BACKGROUND

Drywall (also known as plasterboard, wallboard, sheet rock, gypsum board, buster board, custard board, or gypsum panel) and other panelized wall/ceiling coverings (e.g., thin sheet form) are a common building materials used as facing for walls or ceilings in most modern housing and commercial construction.

Drywall and like building panels are typically connected to wall or ceiling studs or other supportive building framework by using nails and/or screws and/or adhesives. A common issue with traditional building paneling installation methods via screws or nails (or other like fasteners) is referred to as "nail/screw pops." Nail/screw pops form a dimpling on the surface of the panel because a screw or nail has been worked free or because the nail or screw has been put in too deeply and through the panel. This is also an indication that the panel is not being supported by the screws or nails. To mitigate dimpling, adhesives or tapes are used to connect the panel to the studs prior to putting in screws or nails. However, while using adhesives or tapes mitigates the problem, dimpling is not eliminated because often uneven surfaces result in the adhesive or tape not bonding properly.

Another issue with using screws or nails and adhesives or tapes to attach wall/ceiling covering panels to support structure (e.g., headers, footers, studs, etc.) is extreme temperatures and changes in temperature. Drywall and other panels may be installed on building surfaces that have temperatures within a range from below 10° F. to above 110° F. Use of adhesives and nails or screws limit the ability of materials to expand or contract with temperature changes, causing panel warping or connectivity loss, and also nail/screw "pops."

When it comes to replacement of installed drywall and like panels, the panels/sheets are generally ripped away, with the panels being broken during removal as traditional attachment/coupling techniques are not reversible (i.e., allow for selective de-coupling). It is common that a significant amount of residue is left on the support framing/members (along with the nails or screws) after removal of panels from framing members. This residue typically must be removed before new drywall/panels can be installed. Also, the use of both adhesive and screws or nails may damage the support framing when the drywall/panels are removed, requiring that the support framing be replaced.

Thus, a need exists to prevent dimpling of drywall or like construction/building panels, and for devices and systems that provide for quicker, stronger, easier, cleaner and/or less destructive panel removal.

Further, additives or materials are often applied to or included in drywall and like panels to add water resistance and fire resistance. Sound dampening is usually achieved by using multiple layers of panels. It difficult to achieve water resistance, sound dampening, and fire resistance without using multiple layers of panels. Thus, a need also exists for panel attachment devices, systems and methods that improve the water resistance, sound dampening and/or fire resistance of construction/building structures that include panels attached to frame members.

A need also exists to include safety and ergonomic features to construction/building structures constructed with drywall or like panels, and the processes of constructing them.

SUMMARY

The present disclosure provides, in one aspect, a drywall or other building/construction panel installation system having a panel/sheet with a front side and a back side, a frame/framing member, and a touch fastener. The touch fastener includes a first fastening component and a second fastening component configured for attachment to two opposing surfaces to be removably fastened, the first fastening component attached to the back side of the panel/sheet and the second fastening component attached to framing member. The framing member may be disposed in a wall, floor or ceiling space, for example. The panel/sheet is disposed in relation to the framing member such that the first fastening component is operably engaged with the second fastening component.

A further aspect of the present disclosure provides a method for installing panels, including providing a touch fastener having a first fastening component and a second fastening component configured for attachment to two opposing surfaces to removably be fastened. The method includes providing a panel/sheet having a front side and a back side, with the first fastening component attached to the back side. The method further comprises providing a fastening device or member, where the second fastening component is part of or configured to be coupled to a framing member. The next steps includes connecting the fastening device or member to second framing members, and aligning the panel/sheet such that the first fastening component and the second fastening component become engaged and coupled.

In another aspect, the present disclosure provides a framing and panel fastening device. The device comprises: a substantially planar interface portion comprising an inner side and an outer side opposing the inner side in a thickness direction, the outer side comprising a first touch fastening component of a touch fastener defining an exposed outer face of the interface portion, the first touch fastening component configured to removably couple with a second touch fastening component when operatively engaged therewith; a first side wall portion extending in the thickness direction from the inner side of the interface portion; and a second side wall portion extending in the thickness direction from the inner side of the interface portion. The interface portion extends laterally between the first and second side wall portions such that the interface portion and the first and second side wall portions form an inner channel configured to receive and couple to at least a front face portion of a framing member therein. The interface portion and the first and second side wall portions are elongated along a length direction.

In some embodiments, the touch fastener comprises a hook and loop fastener, the first touch fastening component comprising a loop component or a hook component of the hook and loop fastener, and the second touch fastening component comprising the other of the loop component or the hook component of the hook and loop fastener.

In some embodiments, an inner side of the first side wall portion defines a first inner planar engagement surface, the second side wall portion defines a second inner planar engagement surface and the inner side of the interface portion defines a third inner planar engagement surface, and wherein the device is configured such that the first, second and third planar engagement surfaces engage respective surfaces of the framing member when the framing member is received within the inner channel.

In some embodiments, the first side wall portion, the second side wall portion and the interface portion are integral. In some embodiments, the interface portion and the first touch fastening component are integral such that the first touch fastening component is formed via the material of the interface portion. In some such embodiments, the interface portion is formed of a metal material or a polymer material.

In some embodiments, the first and second side wall portions are orientated substantially perpendicular to the interface portion. In some embodiments, the first and second side wall portions include at least one mounting through hole extending therethrough from an outer side thereof to the inner channel, the at least one mounting through hole of the first and second side wall portions being configured to receive a fastening member therethrough to couple the device and the framing member together. In some such embodiments, the at least one mounting through hole of the first and second side wall portions are elongated along the length direction.

In some embodiments, the framing member is a dimensional framing stud, header, footer or joist formed of wood or metal, and the inner channel is configured to receive and couple to at least a front face portion of the framing stud, header, footer or joist.

In some embodiments, the interface portion and the first touch fastening component extend laterally past at least one of the first and second side wall portions. In some embodiments, the first side wall portion extends in the thickness direction further from the interface than the second wide wall portion.

In some embodiments, the device further comprises a substantially planar second interface portion spaced from the interface portion in the thickness direction, the second interface portion comprising a second inner side and a second outer side opposing the second inner side in the thickness direction, the second outer side comprising a second touch fastening component of a second touch fastener defining an exposed outer face of the second interface portion that opposes the outer face of the interface portion, the second touch fastening component configured to removably couple with a third touch fastening component when operatively engaged therewith. In some such embodiments, the inner side of the interface portion and the second inner side of the second interface portion face toward each other in the thickness direction, and wherein the first wall portion extends between the inner side of the interface portion and the second inner side of the second interface portion face. In some such embodiments, the interface portion, the first side wall portion and the second interface portion form a second inner cavity that is configured to receive the framing member therein with a front face of the framing member engaged with the interface portion, a back face of the framing member engaged with the second inner side of the second interface portion and an inner side of the first side wall portion engaged with a side surface of the framing member extending between the front and back faces thereof. In some such embodiments, the second side wall portion terminates at a location along the thickness direction that is spaced from the second interface portion such that an opening is formed between a free end of the second side wall portion and the second interface portion in the thickness direction.

In another aspect, the present disclosure provides a method of fastening a building panel to one or more framing members. The method comprises: coupling at least one framing and panel fastening device to a framing member such that at least a front face portion of the framing member is received within an inner channel of the at least one framing and panel fastening device. The at least one framing and panel fastening device comprises: a substantially planar interface portion comprising an inner side and an outer side opposing the inner side in a thickness direction, the outer side comprising a first touch fastening component of a touch fastener defining an exposed outer face of the interface portion, the first touch fastening component configured to removably couple with a second touch fastening component of the touch fastener when operatively engaged therewith; a first side wall portion extending in the thickness direction from the inner side of the interface portion; and a second side wall portion extending in the thickness direction from the inner side of the interface portion. The interface portion extends laterally between the first and second side wall portions such that the interface portion and the first and second side wall portions form the inner channel. The interface portion and the first and second side wall portions are elongated along a length direction. The method further comprises obtaining at least one building panel having a front side and a back side including the second touch fastening component coupled thereto. The method also comprises disposing the building panel in relation to the at least one framing and panel fastening device such that the first touch fastening component and the second touch fastening are operatively engaged to fasten the building panel and the framing member together.

In some embodiments, the coupling of the at least one framing and panel fastening device to the framing member comprises fastening the at least one framing and panel fastening device to the framing member via at least one screw or nail that passes through the at least one framing and panel fastening device and into the framing member.

In some embodiments, the coupling of the at least one framing and panel fastening device to the framing member comprises fastening a plurality of the framing and panel fastening devices to differing portions of the framing member along a length of the framing member.

In another aspect, the present disclosure provides a system for paneling a framework comprising: at least one framing and panel fastening device; and at least one building panel. The at least one framing and panel fastening device comprises: a substantially planar interface portion comprising an inner side and an outer side opposing the inner side in a thickness direction, the outer side comprising a first touch fastening component of a touch fastener defining an exposed outer face of the interface portion, the first touch fastening component configured to removably couple with a second touch fastening component when operatively engaged therewith; a first side wall portion extending in the thickness direction from the inner side of the interface portion; and a second side wall portion extending in the thickness direction from the inner side of the interface portion. The interface portion extends laterally between the first and second side wall portions such that the interface portion and the first and second side wall portions form an inner channel configured to receive and couple to at least a front face portion of a framing member of a framework therein. The interface portion and the first and second side wall portions are elongated along a length direction. The at least one building panel comprises a front side and a back side including the second touch fastening component coupled thereto.

It should be appreciated that all combinations of the foregoing concepts and additional concepts discussed in greater detail below (provided such concepts are not mutually inconsistent) are contemplated as being part of the inventive subject matter disclosed herein and may be used to achieve the benefits and advantages described herein.

These and other objects, features and advantages of this disclosure will become apparent from the following detailed description of the various aspects of the disclosure taken in conjunction with the accompanying drawings.

BRIEF DESCRIPTION OF THE DRAWINGS

These and other features, aspects, and advantages of the present disclosure will become better understood when the following detailed description is read with reference to the accompanying drawings, which are not necessarily drawn to scale and in which like reference numerals represent like aspects throughout the drawings, wherein.

DETAILED DESCRIPTION

Figure 1A:
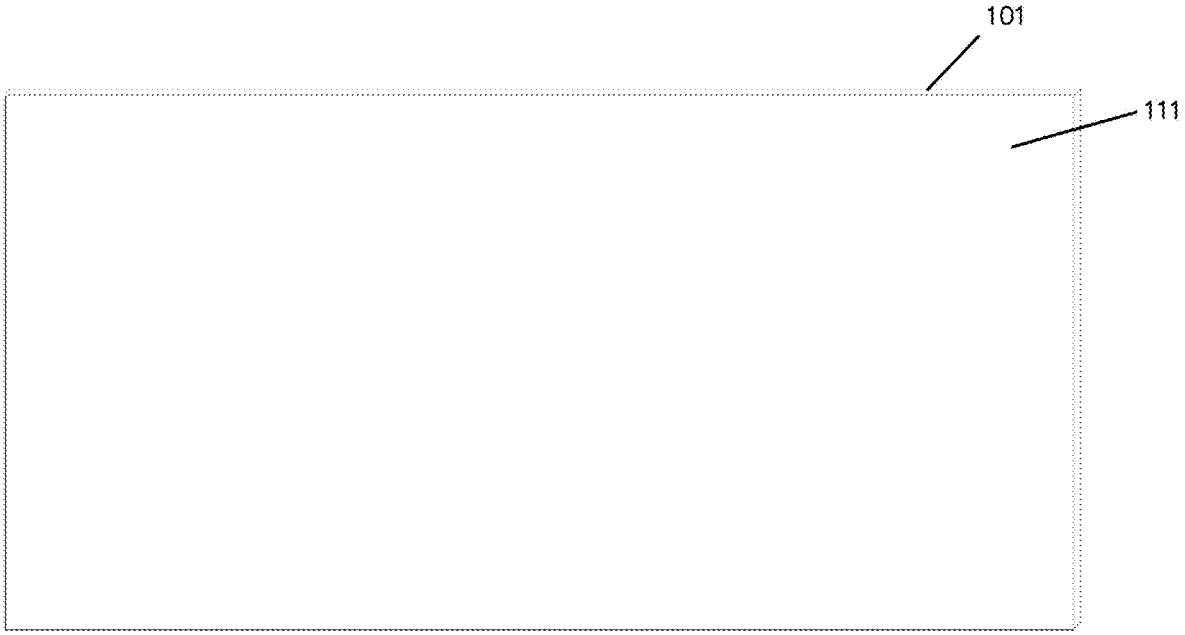
FIG. 1A is an elevational front perspective view of a sheet of a construction/building panel (e.g., a drywall panel), in accordance with an aspect of the present disclosure.

The present disclosures will be discussed hereinafter in detail in terms of various exemplary embodiments according to the present disclosure with reference to the accompanying drawings. In the following detailed description, numerous specific details are set forth in order to provide a thorough understanding of the inventions. It will be obvious, however, to those skilled in the art that the present inventions may be practiced without these specific details. In other instances, well-known structures are not shown in detail in order to avoid unnecessary obscuring of the present inventions.

Aspects of the present disclosure and certain examples, features, advantages, and details thereof, are explained more fully below with reference to the non-limiting examples illustrated in the accompanying drawings. Descriptions of well-known materials, fabrication tools, processing techniques, etc., are omitted so as not to unnecessarily obscure the relevant details. It should be understood, however, that the detailed description and the specific examples, while indicating aspects of the disclosure, are given by way of illustration only, and are not by way of limitation. Various substitutions, modifications, additions, and/or arrangements, within the spirit and/or scope of the underlying inventive concepts will be apparent to those skilled in the art from this disclosure.

Approximating language, as used herein throughout disclosure, may be applied to modify any quantitative representation that could permissibly vary without resulting in a change in the basic function to which it is related. Accordingly, a value modified by a term or terms, such as "terms "substantially", "approximately", "about", "relatively," or other such similar terms is not limited to the precise value specified, and is used to describe and account for small fluctuations, such as due to variations in processing, from a reference or parameter. Such small fluctuations include a zero fluctuation from the reference or parameter as well. For example, these terms can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%. In some instances, the approximating language may correspond to the precision of an instrument for measuring the value.

Terminology used herein is for the purpose of describing particular examples only and is not intended to be limiting. As used herein, the singular forms "a", "an" and "the" are intended to include the plural forms as well, unless the context clearly indicates otherwise. Furthermore, references to "one example" are not intended to be interpreted as excluding the existence of additional examples that also incorporate the recited features. Moreover, unless explicitly stated to the contrary, the terms "comprising" (and any form of "comprise," such as "comprises" and "comprising"), "have" (and any form of "have," such as "has" and "having"), "include" (and any form of "include," such as "includes" and "including"), and "contain" (and any form of "contain," such as "contains" and "containing") are used as open-ended linking verbs. As a result, any examples that "comprises," "has," "includes" or "contains" one or more step or element possesses such one or more step or element, but is not limited to possessing only such one or more step or element. As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable or suitable. For example, in some circumstances, an event or capacity can be expected, while in other circumstances the event or capacity cannot occur—this distinction is captured by the terms "may" and "may be." As used herein, the word "exemplary" or "illustrative" means "serving as an example, instance, or illustration." Any implementation described herein as "exemplary" or "illustrative" is not necessarily to be construed as preferred or advantageous over other implementations. Moreover, in the present description, the terms "upper", "lower", "left", "rear", "right", "front", "vertical", "horizontal" and derivatives thereof shall relate to the orientation as shown in FIG. 1.

The terms "connect," "connected," "contact," "coupled" and/or the like are broadly defined herein to encompass a variety of divergent arrangements and assembly techniques. These arrangements and techniques include, but are not limited to (1) the direct joining of one component and another component with no intervening components therebetween (i.e., the components are in direct physical contact); and (2) the joining of one component and another component with one or more components therebetween, provided that the one component being "connected to," "contacting" or 'coupled to" the other component is somehow in operative communication (e.g., electrically, fluidly, physically, optically, etc.) with the other component (notwithstanding the presence of one or more additional components therebetween).

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Touch fasteners are also referred to as hook and loop fasteners, hook and pile fasteners, hook and hoof fasteners and Velcro®. Touch fasteners have a first fastening component and a second fastening component that are configured to removably couple with each other, for example, a hook component and a loop component, respectively. The hook and loop components are connected to opposing surfaces/objects that are to be coupled/attached/fastened together. For example, when hook and loop components are pressed together, a densely packed plurality of small hooks catches in a densely packed plurality of small loops, fastening the hook and loop components (and the surfaces/objects coupled thereto, respectively) together. Other touch fasteners include, for example, systems that have double hooks for use with loops, or systems that have interlocking, opposably facing mushroom shaped connectors (e.g., Dual Lock® by 3M®), mushrooms and mushrooms, mushroom and loops, and hooks and hooks that engage with each other in a substantially similar manner as traditional hook and loop components.

A feature of touch fasteners is that the two objects/surfaces may be fastened and separated or unfastened (i.e., removably coupled), with the touch fastener being reusable (i.e., the two objects/surfaces being re-coupled with the same touch fasteners). While hook and loop fasteners are described as an example herein, Dual Lock® or the double hook or similar touch fasteners may be used in place of hook and loop. Further, the terms "hook" and "loop" (and the equivalents thereof) are used interchangeably herein, such as a first surface/object that includes a hook component of a hook and loop fastener and a second surface/object that includes a loop component of the hook and loop fastener may alternatively be configured such that the first surface/object includes the loop component and the second surface/object that includes a hook component. Further, the terms "touch fastener" and "hook and loop fastener" (and the equivalents thereof) are used herein to refer generally to any such fastener systems or mechanisms described herein and known in the art that operate on the same or similar principle as traditional hook and loop fasteners (Velcro®) regardless of their inclusion (or lack thereof) "hooks" and "loops." Thus, the terms "touch fastener" and "hook and loop fastener" (and the equivalents thereof) are used herein broadly to encompass all touch fasteners or fastening components that comprise a plurality of male members and a plurality of female member, wherein the male members extend under and/or through a portion of the female members such that the male and female members become intertwined/intertwined or otherwise prevented from becoming naturally separate (i.e., without manual intervention to "pull" or otherwise separate the male and female members). The "hooks" may thereby be any shape, such as but not limited to "T", "L" "J" or "Z" shaped, and the "loops" may or may not cross or connect with itself (e.g., may or may not form a complete bend that crosses itself).

In embodiments disclosed herein, the systems and methods for fastening (e.g., removably attaching) panels or sheets (e.g., drywall panels, or other wall/ceiling/floor panels) to one or more frame/framing/framework members (e.g., one or more wood or metal stud) utilize touch fasteners or constructs. The touch fasteners may comprise a hook component and a loop component. In some such embodiments, hook component may be formed from a plastic material, a woven fabric material, or a combination of plastic and woven fabric material. In some embodiments, the loop component may be formed from a plastic material, a woven fabric material, a non-woven fabric material, or velour. In some embodiments, the hook or loop portions of the touch fastener have a base that is, for example, a fabric or plastic material. In accordance with aspects of the disclosure, other materials may be used in the base. The base is generally a flexible or bendable material. The back sides of the hook or loop that are opposite the operable hook or loop include, for example, an adhesive, a solvent, or a heat sensitive material for attaching/fastening/coupling to the opposing surfaces to be connected. In some embodiments, the sides of the hook or loop that are opposite the operable hook or loop include a pressure sensitive adhesive or a heat activated adhesive for attaching/fastening/coupling to a surface/object. Other backing adhesion materials of the back side of the bases include, for example, a heat welding compound, or a solvent.

Figure 1B:
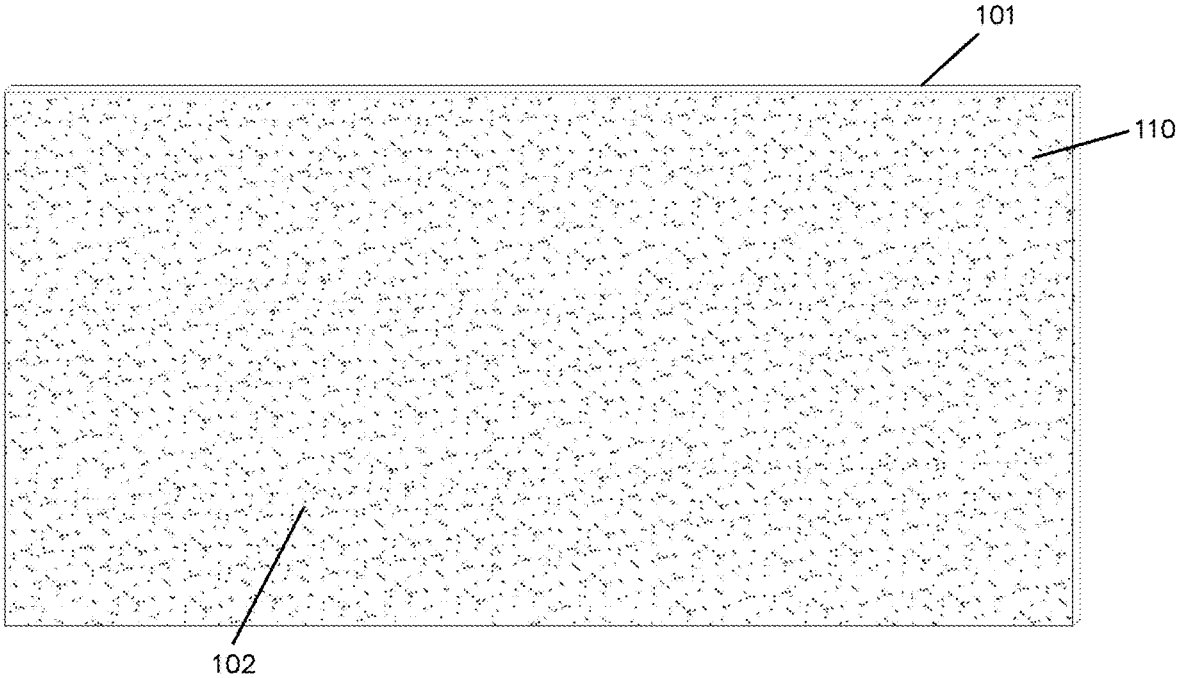
FIG. 1B is an elevational back perspective view of the sheet of the panel of FIG. 1A with loop/look fastener attached thereto, in accordance with an aspect of the present disclosure.
Figure 3:
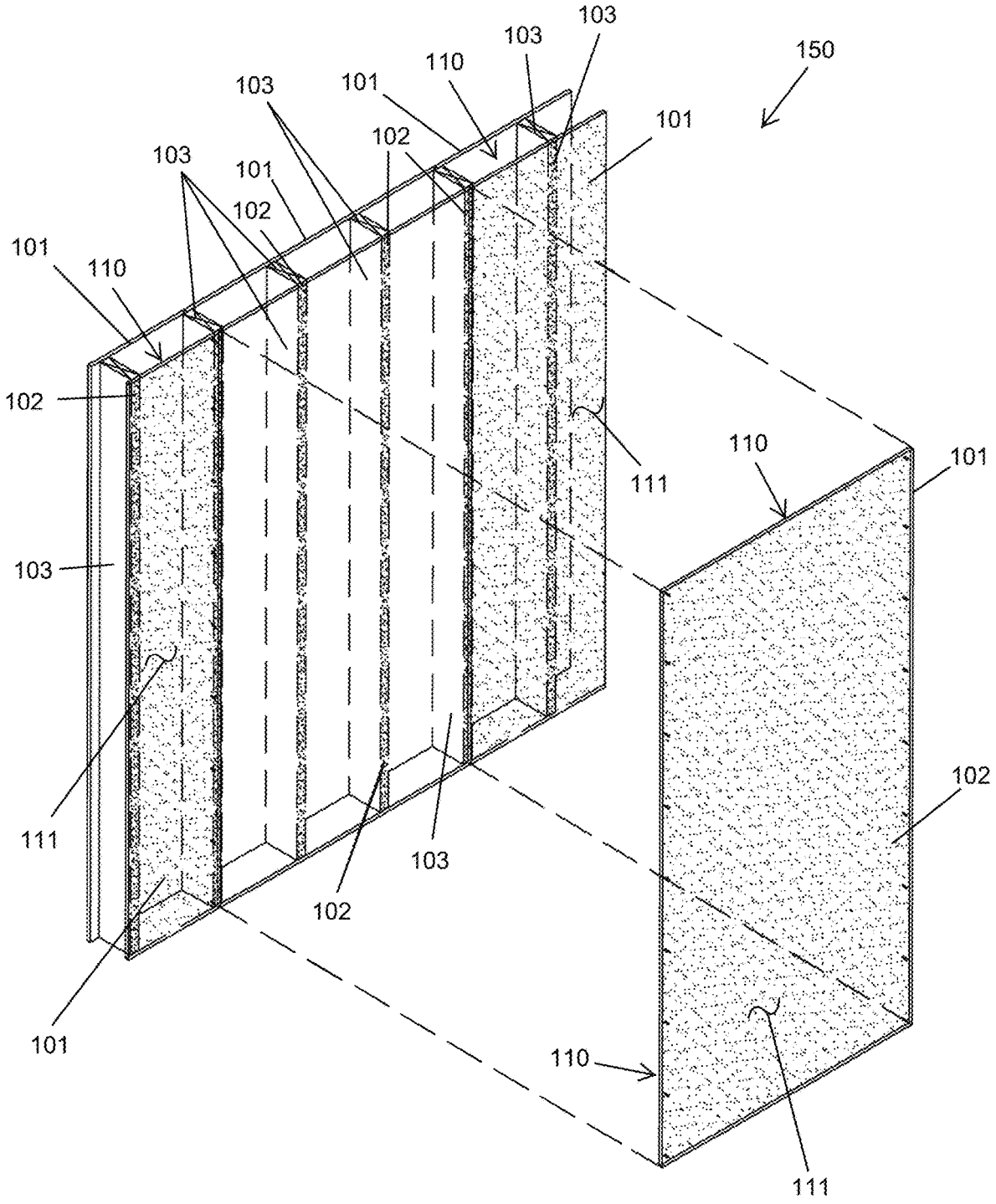
FIG. 3 is an elevational view of a wall including a plurality of panels of the panel of FIGS. 1A and 1B and a plurality of framing members of the framing member of FIG. 2, in accordance with an aspect of the present disclosure.

FIGS. 1A, 1B and 3 illustrate an exemplary embodiment of a wall/ceiling/floor/partition covering panel/sheet/material 101, such as for building or construction (e.g., residential and commercial). As noted above, the most commonly utilized building panels/sheets 101 is drywall (also known as plasterboard, wallboard, sheet rock, gyprock, gypsum board, or gypsum panel). As such, the panel/sheet 101 may be referred to herein as panel/sheet 101 (e.g., drywall or the like), however it is hereby contemplated that the panel/sheet 101 may comprise any material, composition or configuration other than drywall, and be configured in any shape or size. The panel 101 is thus any sheet of material that may be utilized in covering or "paneling" a framework/framing to form a building structure, such as a partition, wall, ceiling, floor or the like.

As shown in FIGS. 1A, 1B and 3, a panel/sheet 101 may have/comprise an inner surface 110 and an outer surface 111. The panel/sheet 101 is generally affixed to a framing member such that the inner surface 110 faces the interior of the wall and the outer surface 111 faces outwards becoming the wall surface. As shown in FIGS. 1A, 1B and 3, the inner surface 110 of the panel/sheet 101 includes a first component 102 of a touch/hook and loop fastener system/mechanism/construct thereto. In some such embodiments, the first component 102 of the touch/hook and loop fastener may comprise a loop component. As noted above, the first touch fastener component 102 may be attached (e.g., fixedly or removably) to the inner surface 110 of the panel/sheet 101. As such, the inner surface 110 of the panel/sheet 101 may comprise a first fastening surface.

In some embodiments, the panel/sheet 101 comprises a panel made of calcium sulfate dihydrate (gypsum), generally with a paper-based front facing (that forms the outer surface 111) and back facing (that forms the inner surface 110). In still other aspects, other additives or materials are added to the gypsum, added as additional layers, or used in place of, or in addition to, the paper-based facing. These additives or material provide additional properties such as water-resistance, and/or fire-resistance, and/or sound-dampening, and/or mold-resistance.

The panel/sheet 101 may comprise industrial (e.g., residential and/or commercial construction) standard heights, widths and/or thicknesses. For example, a standard widths may comprise about 48 in and about 54 in, standard heights may comprise about 8 ft, about 10 ft, about 12 ft, and about 14 ft, and standard thicknesses may comprise about ¼ in, about ⅜ in, about ½ in, and about ⅝ in. The weight of the panel/sheet 101 may range from about 25 lbs to about 140 lbs. In some embodiments, the panel/sheet 101 may comprise a thickness of about ½ in and a weight of about 1.7 $lbs/ft^2$, or a thickness of about ⅝ in and a weight of about 2.3 $lbs/ft^2$.

In some embodiments, a panel/sheet 101 (e.g., drywall or the like) may have dimensions of 1 ft.×4 ft.×⅝ in and/or two 2 in wide by 12 in long strips of touch fastener 102, where the first connecting portion (e.g., a loop component) 102 is attached to the inner surface 110 of the panel/sheet 101 (e.g., drywall or the like) and the second connecting portion (e.g., a hook component) 102 is attached to an outer-facing surface of a vertical support member/surface. In some such embodiments, the touch fastener 102 may be configured a peel strength of about 1 psi. In such embodiments, the panel/sheet 101 (e.g., drywall or the like) will remained mounted to the vertical support member/surface, and require intentional and significant effort to separate the first connecting component 102 from the second connecting component 102. Further, in such embodiments, removal of the panel/sheet 101 (e.g., drywall or the like) from the vertical support member/surface (i.e., separation of the first and second touch fastener components 102) does not damage the panel/sheet 101 (e.g., drywall or the like). Still further, in such embodiments, removal of the panel/sheet 101 (e.g., drywall or the like) from the vertical support member/surface (i.e., separation of the first and second touch fastener components 102) does not damage the first and second touch fastener components 102 such that they are usable to re-couple together (e.g., for at least two more touch fastener engagements).

Peel strength and sheer strength are common measures for hook and loop fasteners. In embodiments disclosed herein, panel/sheets 101 are supported with hook and loop components 102 having sheer strength ranging from, for example, about 0.3 psi to about 25 psi. As further disclosed herein, a desired peel strength to prevent inadvertent removal but easy intentional removal may be, for example, from about 0.3 lbs per inch width to about 1.2 lbs per inch width, including all ranges and subranges therein as appropriate for the mechanics of the panel/sheet 101 (e.g., drywall or the like) installation and removal.

Figure 2:
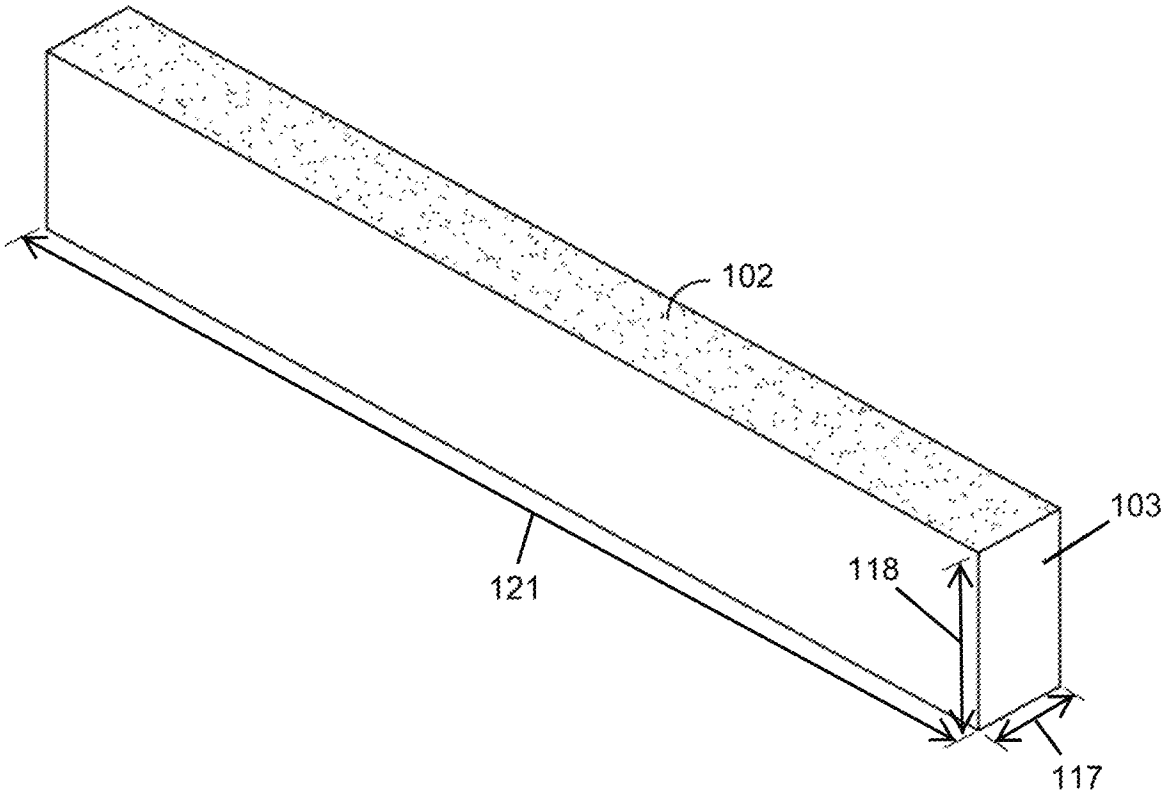
FIG. 2 is an elevational perspective view of a framing member with hook and a loop fastener attached thereto, in accordance with an aspect of the present disclosure.
Figure 4:
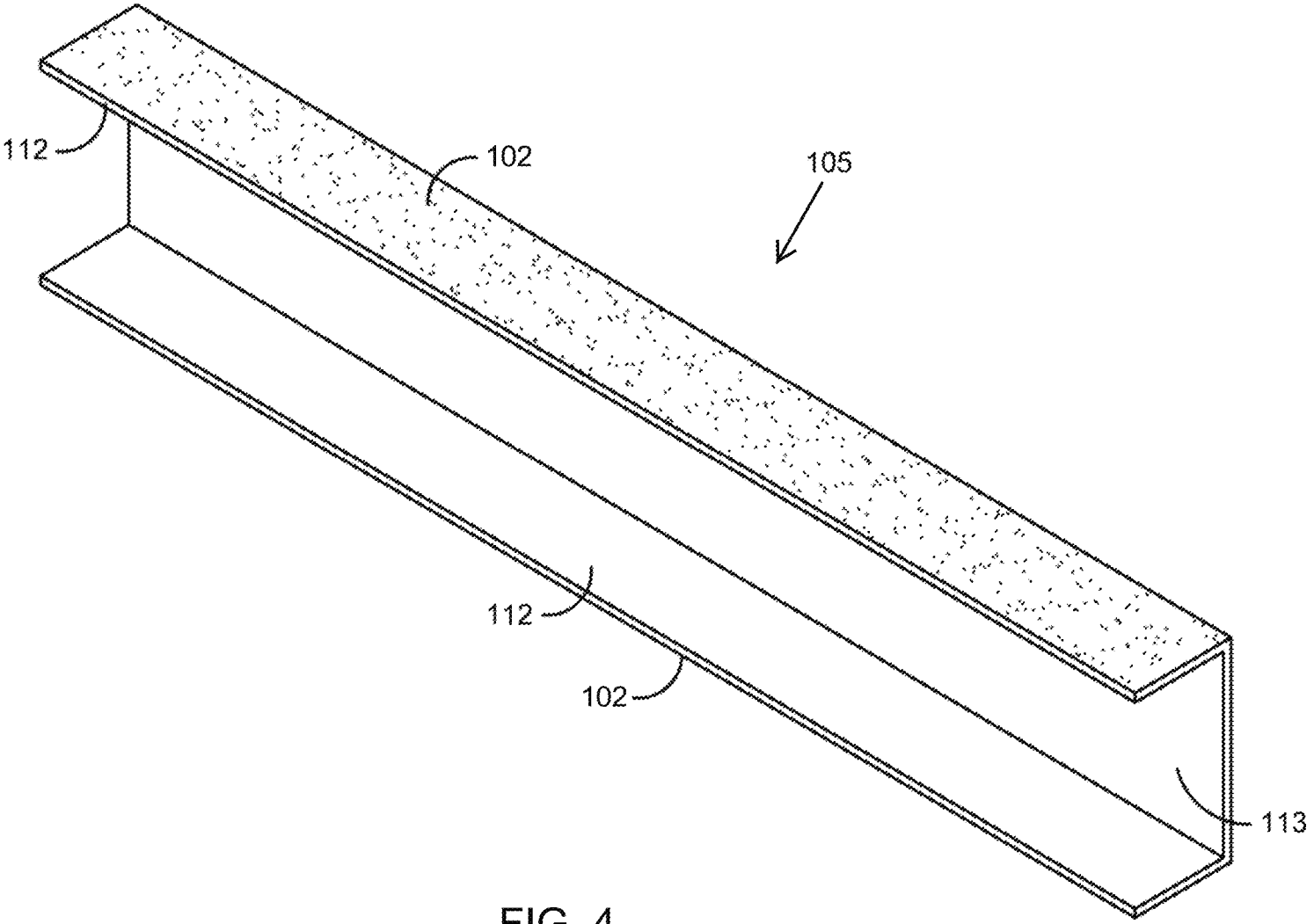
FIG. 4 is an elevational perspective view of another framing member with hook and a loop fastener attached thereto, in accordance with an aspect of the present disclosure.
Figure 5:
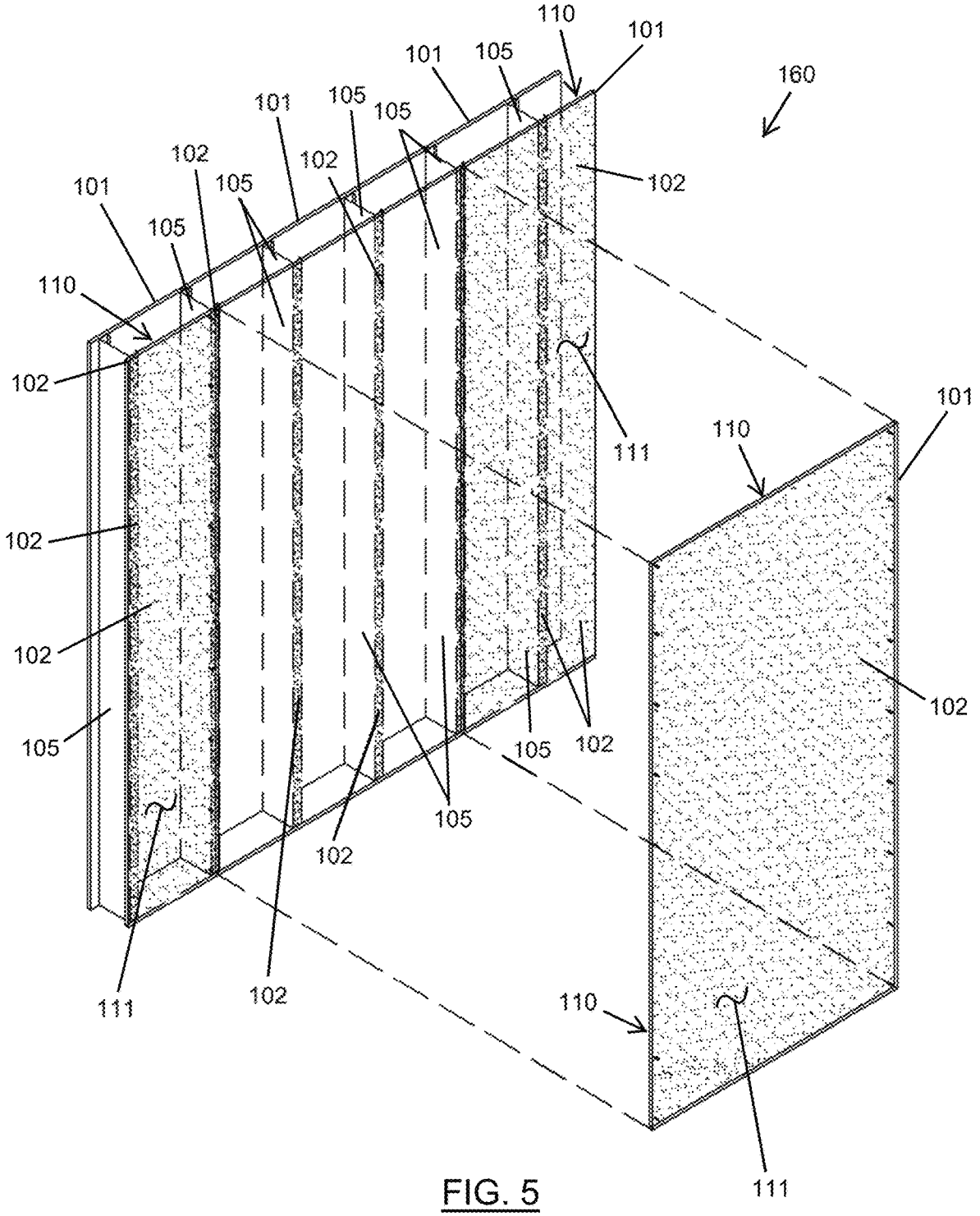
FIG. 5 is an elevational view of a wall structure including a plurality of panels of the panel of FIGS. 1A and 1B and a plurality of framing members of the framing member of FIG. 4, in accordance with an aspect of the present disclosure.
Figure 6:
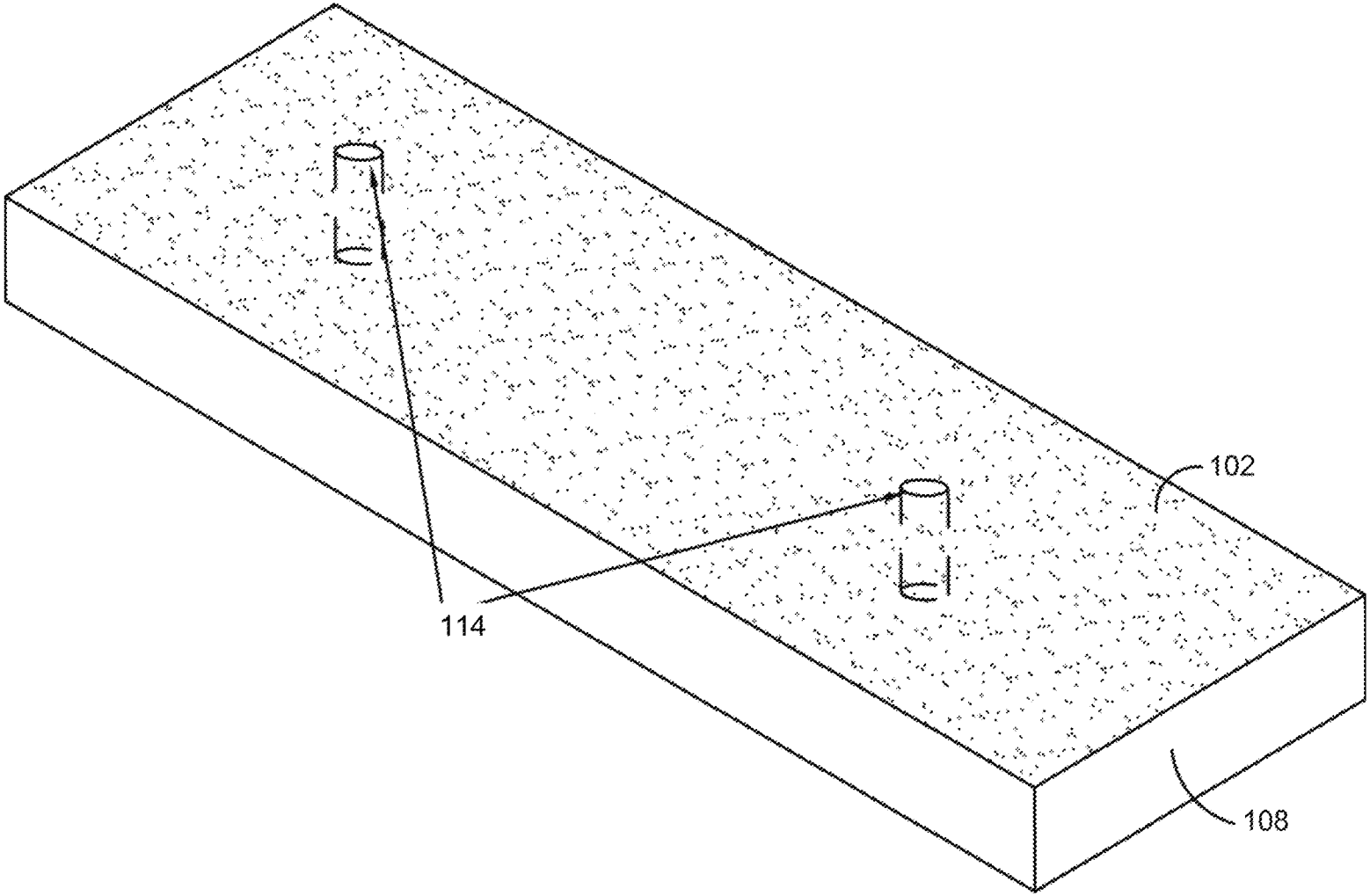
FIG. 6 is an elevational perspective view of a furring strip with hook and a loop fastener, in accordance with an aspect of the present disclosure.
Figure 7A:
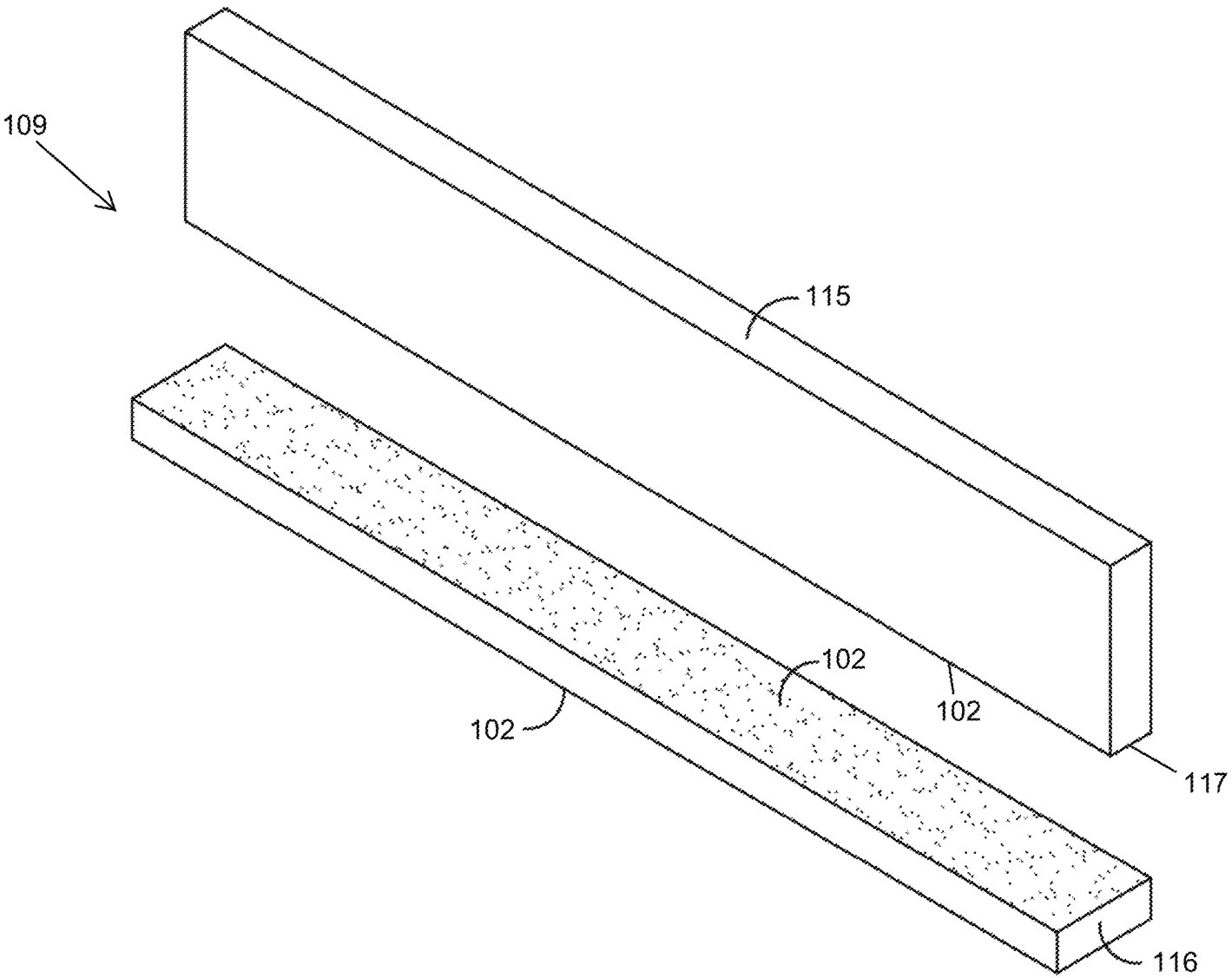
FIG. 7A is an elevational perspective exploded view of an adjustable furring strip with hook and a loop fastener, in accordance with an aspect of the present disclosure.
Figure 7B:
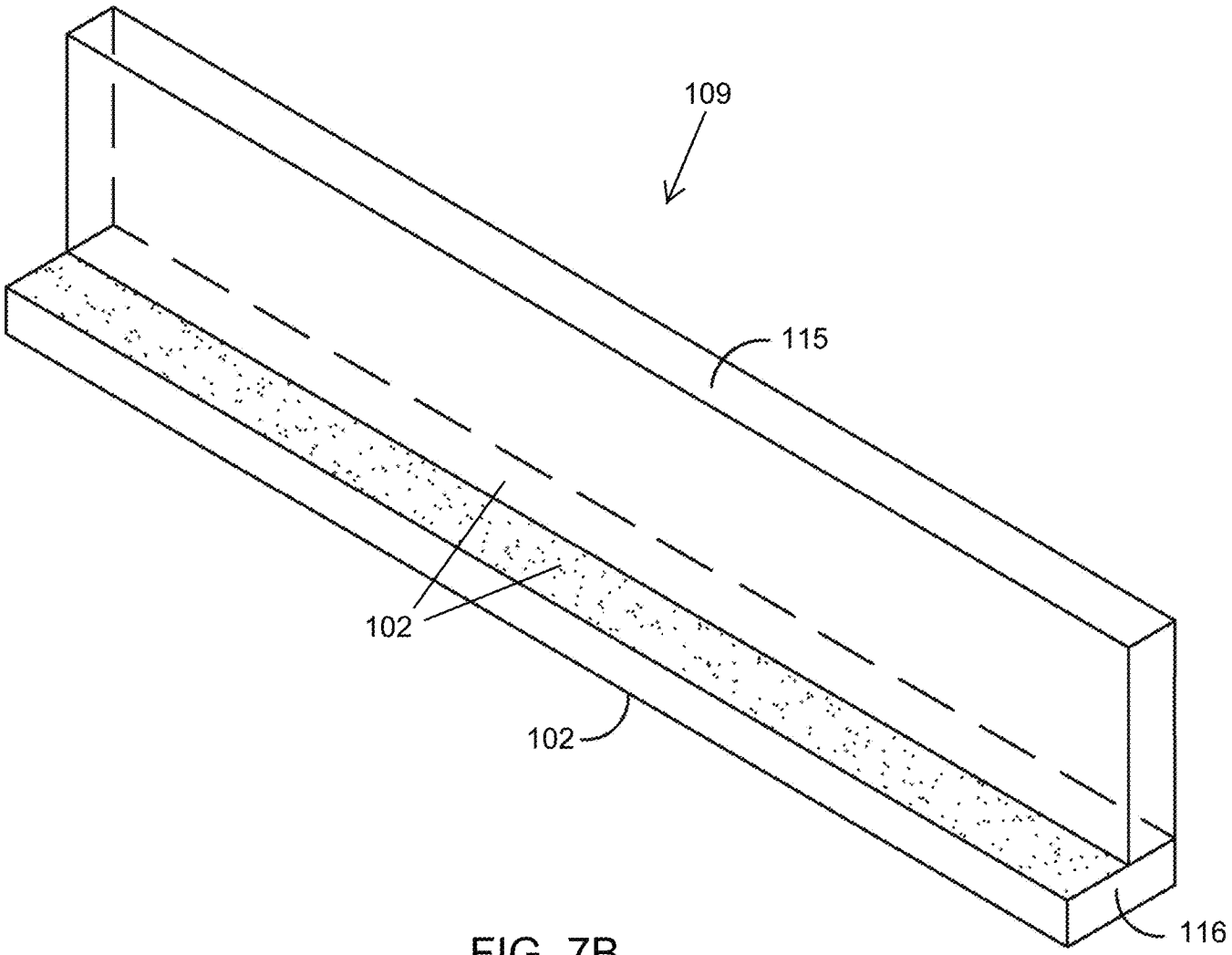
FIG. 7B is an elevational perspective view of the adjustable furring of FIG. 8A assembled, in accordance with an aspect of the present disclosure.
Figure 8A:
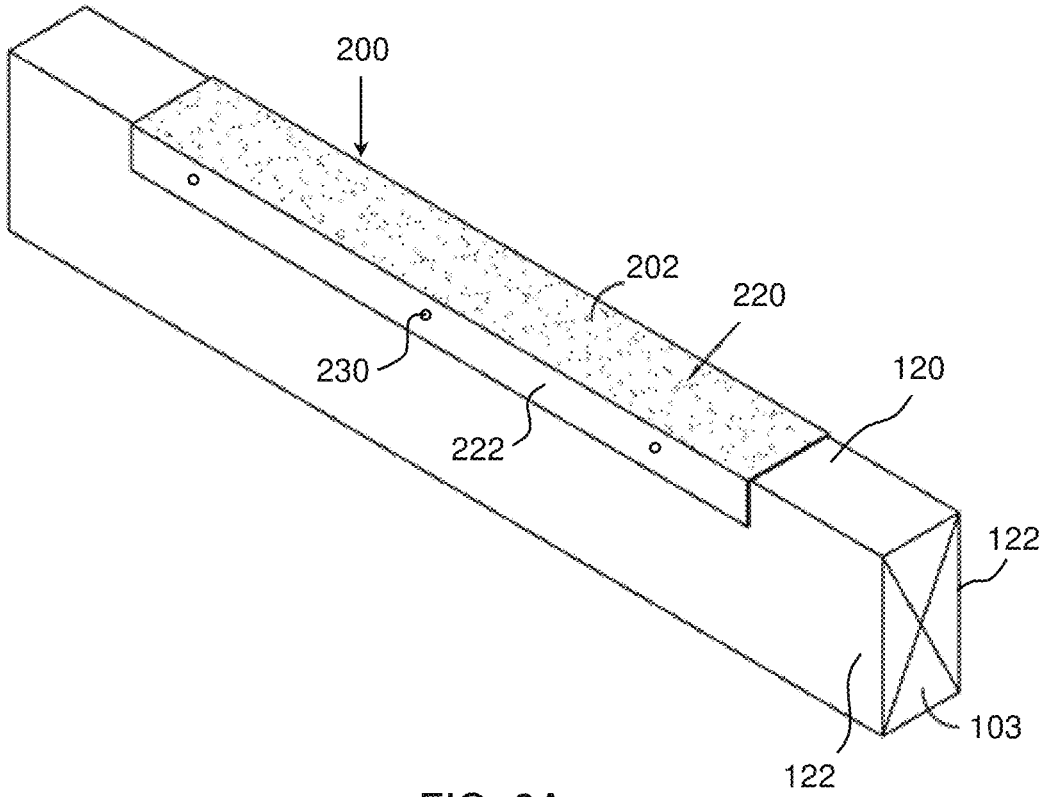
FIG. 8A is an elevational perspective view of a coupling device with a channel and a hook and a loop fastener operatively coupled to a framing member for coupling a panel thereto, in accordance with an aspect of the present disclosure.
Figure 8B:
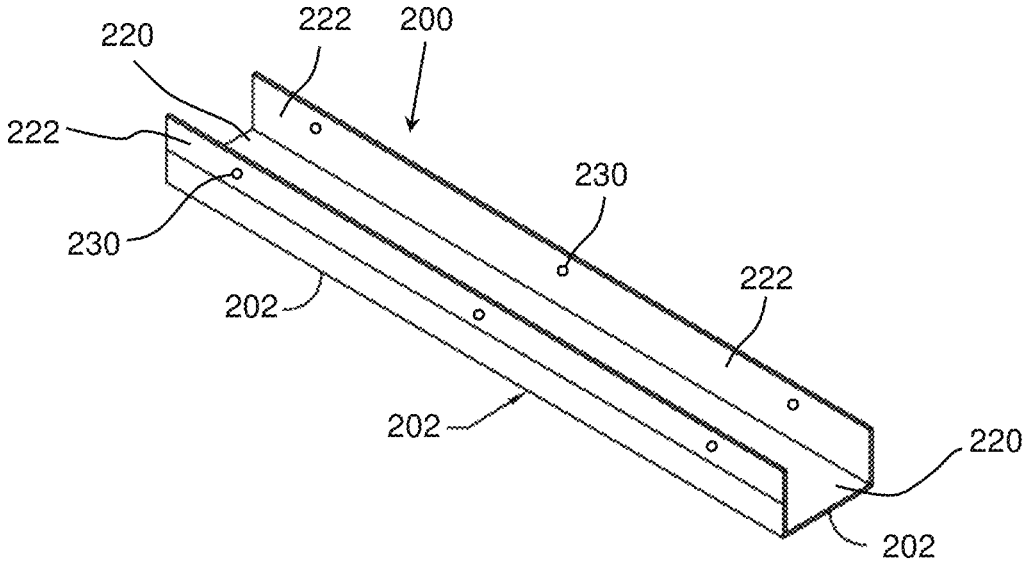
FIG. 8B is an elevational perspective view of a back/rear side of the coupling device of FIG. 8A, in accordance with an aspect of the present disclosure.
Figure 9:
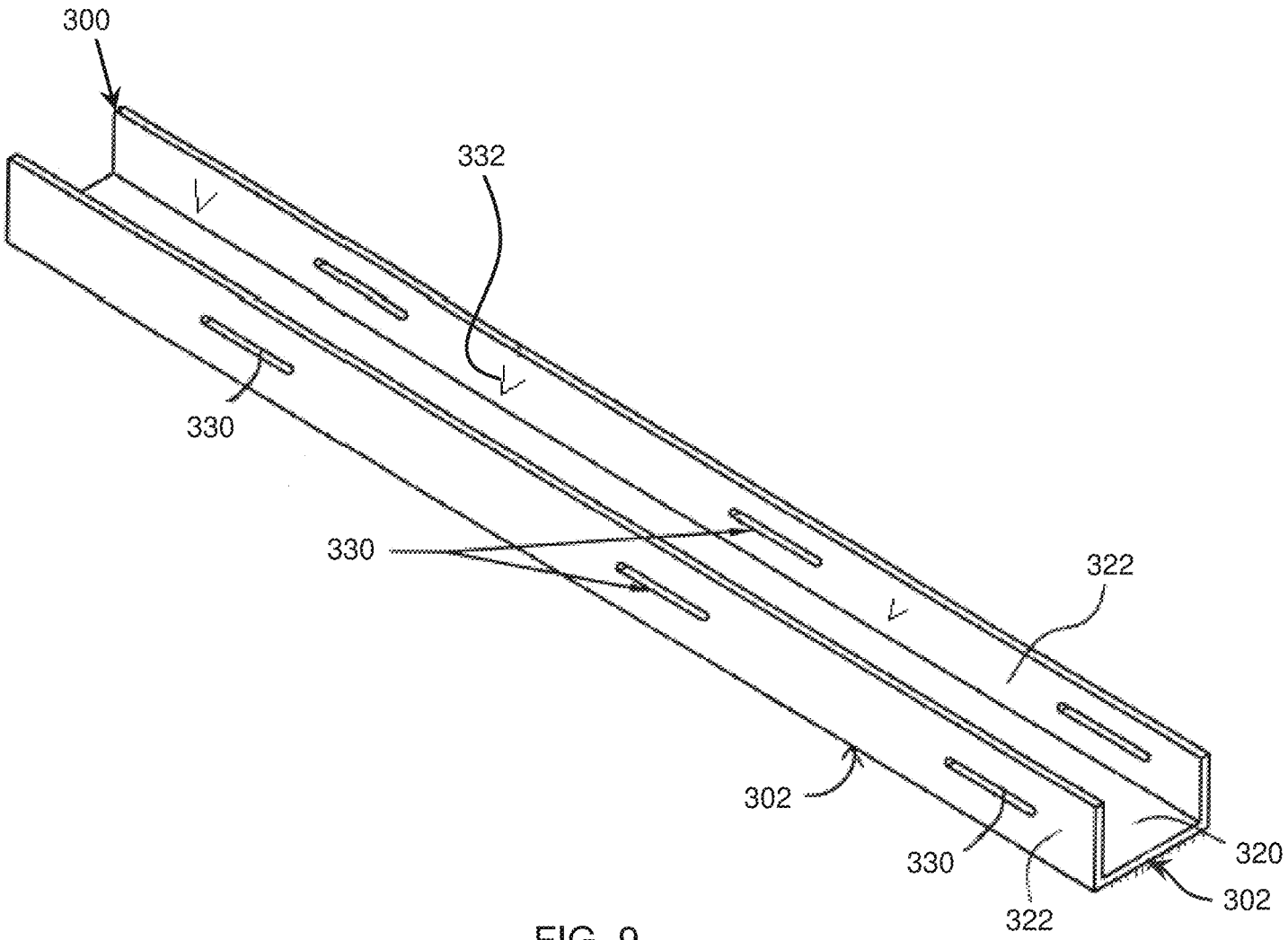
FIG. 9 is an elevational perspective view of a rear side of another coupling device with a channel and a hook and a loop fastener for coupling a framing member and a panel together, in accordance with an aspect of the present disclosure.

FIGS. 2-10 show various support/framing members that include a touch fastener component 102 for removably coupling with the mating touch fastener component 102 on the panel/sheet 101. For example, an exemplary first framing stud 103/203 (e.g., a wood stud) is shown in FIGS. 2, 3 and 9, an exemplary second framing stud 105/305 (e.g., a metal stud) is shown in FIGS. 4, 5 and 10, an exemplary panel and framing member fastening device 106 for a framing member is shown in FIG. 6, an exemplary framing furring strip 108 is shown in FIG. 7, and an exemplary adjustable framing furring strip 109 is shown in FIGS. 8A and 8B. As shown in FIGS. 2-10, each support/framing member includes at least a portion of one surface covered/including/comprising a touch fastener component 102 (e.g., a hook component) for removably coupling with the mating touch fastener component 102 (e.g., a loop component) on the panel/sheet 101. A such, the support/framing members include a second fastening surface.

FIGS. 2 and 3 illustrate an exemplary first framing member or stud 103. In some embodiments, the first framing member 103 may comprise a wood stud. However, in other embodiments the first framing member or stud 103 may include a differing material and/or be configured differently. The first framing member 103 may comprise a standard size, such as a thickness or depth 117 and a width 118 within the range of about 2 in×4 in to about 2 in×12 in, including all ranges and subranges therein as appropriate for the mechanics of wall or ceiling construction/installation. It is specifically contemplated that although standard sizes of the first framing member 103 (e.g., a wood stud) are disclosed herein, the first framing member 103 (e.g., a wood stud) may equally employ/comprise non-standard or differing sizes and/or materials.

The first framing member 103 (e.g., a wood stud) may be positioned such that its length 121 is (substantially vertically) positioned between a ceiling framing member/plate/sill and a floor/base framing member/sill plate/sole plate. As shown in FIGS. 3 and 9, a series of the framing members 103/203 may be positioned/extended (e.g., substantially vertically) (e.g., between a ceiling plate and a sole plate) to form a wall/ceiling/partition 150/200 (and be positioned within an inner wall/ceiling space). For example, the width 118 may be within the wall space, perpendicular to wall surface. The thickness side 117 of the first framing member 103/203 may be the side or face to which panel/sheet 101/201 (e.g., drywall or the like) is to be attached. Thus, the thickness side 117 may comprise the second fastening surface to which the second fastening component 102/202 of the touch fastener is connected (e.g., the hook component 102). As shown in FIG. 9, the wall space may include other framing and/or wall/ceiling components, such as but not limited to insulation 280.

FIGS. 4 and 5 depict a second framing member 105 (e.g., a metal stud) with, for example, a web portion 113 extending (e.g., perpendicularly) between two flange portions 112. In some embodiments, the cross-section of the second framing member 105 may comprise an I-shape (not shown), and in some other embodiments the cross-section of the second framing member 105 may comprise a C- or U-shape as illustrated in FIGS. 4 and 5 (and FIG. 10). In some embodiments, the two flanges 112 may comprise a standard width of about 1⅜ in, about 1⅝ in, about 2 in, about 2½ in or about 3 in, and/or the web 113 may comprise a standard depth/width within the range of about 2½ in to 14 in, including all ranges and subranges therein. It is specifically contemplated that although standard sizes of the second framing member 105 (e.g., a metal stud) are disclosed herein, the second framing member 105 (e.g., a wood stud) may equally employ/comprise non-standard or differing sizes and/or materials.

The outer-facing surface of one or both of the flanges 112 of the second framing member 105 may be the side(s) or face(s) to which panel/sheet 101 (e.g., drywall or the like) is to be attached. Thus, the outer-facing surface of one or both of the flanges 112 may comprise the second fastening surface that includes the second fastening component 102 (e.g., the hook component 102).

As shown in FIGS. 5 and 10, the second framing member 105/305 (e.g., a metal stud) may be positioned such that its length is (substantially vertically) positioned between a ceiling framing member/plate/sill and a floor/base framing member/sill plate/sole plate. As shown in FIGS. 5 and 10, a series of the framing members 105/305 may be positioned/extended (e.g., substantially vertically) (e.g., between a ceiling plate and a sole plate to form a wall/ceiling/partition 160/300 (and be positioned within an inner wall/ceiling space). The panel/sheet 101 (e.g., drywall or the like)/301 may be attached to the outer-facing surfaces of one (or both) of the two flanges 112, as shown in FIGS. 5 and 10. Thus, the second fastening component 102/302 of the touch fastener is provided on one or both of the two flanges 112, such as, for example, the hook component 102/302, as shown in FIGS. 4, 5 and 10. As shown in FIG. 10, the wall space may include other framing and/or wall/ceiling components, such as but not limited to insulation 380.

Generally referring to FIGS. 2-5, both the first framing member 103 (e.g., a wood stud) and the second framing member 105 (e.g., a metal stud) may be used in ceilings as joists. The term stud and joist are used interchangeably, and the joist may also be referred to as a ceiling stud. The length 121 of a stud can be any length, and may depend on the structure being built. For example, the length 121 the first framing member 103 (e.g., a wood stud) and the second framing member 105 (e.g., a metal stud) may be within the range of about 6 ft to about 16 ft, including all ranges and subranges therein. Structures may also have multiple studs substantially vertically stacked for use in taller walls. In the case of ceilings, the length 121 of the joist may be horizontally disposed, with the stud thickness/flange side 117/112, having the touch/hook and loop component 102, and positioned to connect to the mating touch/hook and loop component 102 on the back side 110 of the sheet of drywall/panel 101.

The first framing member 103/second framing member 105 may include the touch/hook and loop fastener component 102 (integral or separate and distinct and attached thereto) on one or more surfaces (e.g., one or more outer-facing surfaces) thereof. For example, regarding the second framing member 105 (e.g., a metal stud), the touch/hook and loop fastener component 102 (integral or separate and distinct and attached thereto) may be present on the outer-facing surface of one or both of the two flanges 112. In some embodiments, the first framing member 103/second framing member 105 may be manufactured/pre-configured such that the touch/hook and loop fastener component 102 thereof is provided/present on the surface(s) thereof. In some other embodiments, the first framing member 103/second framing member 105 may be void of the touch/hook and loop fastener component 102, and the first framing member 103/second framing member 105 and/or the touch/hook and loop fastener component 102 may be configured such that the touch/hook and loop fastener component 102 is formed/applied/coupled to/on the outer surface(s) (e.g., at a construction or assembly site).

In some other embodiments, the touch/hook and loop component 102 (e.g., a hook component) may comprise a separate and distinct component/piece/construct than the first framing member 103 (e.g., a wood stud) or the second framing member 105 (e.g., a metal stud) and attached thereto. For example, the touch/hook and loop component 102 may be coupled/attached to the first framing member 103 (e.g., a wood stud) or the second framing member 105

(e.g., a metal stud) via an adhesive, glue, screws, nails, staples, another attachment mechanism or a combination thereof.

In some other embodiments, the touch/hook and loop component 102 (e.g., a hook component) may be integral with the first framing member 103 (e.g., a wood stud) or the second framing member 105 (e.g., a metal stud). For example, the touch/hook and loop component 102 may be formed by the first framing member 103 or the second framing member 105. The material composition of the first framing member 103/second framing member 105 may thereby comprise a material that can form the touch/hook and loop component 102. For example, a framing member 103/105 may be formed of a metal material or a polymer (e.g., plastic polymer) material (or any other material that can be formed into the touch/hook and loop component 102 and act as a support/framing member to physically support one or more panels/panel/sheet 101 (e.g., drywall or the like).

In one exemplary embodiment, the first framing member 103/second framing member 105 may be formed of a metal material (e.g., aluminum, steel, etc.) and include at least one integral touch/hook and loop component portion 102 (e.g., a hook component portion) on at least one outer-facing surface thereof. For example, in some such embodiments the outer surface(s) of the (e.g., metal) first framing member 103 or the (e.g., polymer/plastic) second framing member 105 may be worked with a perforated roller die that is configured to form the material of the first framing member 103/second framing member 105 (at the worked outer surface) to form the touch/hook and loop component 102, such as the hook component/portion of a hook and loop fastener system/mechanism/construct. It is noted that other methods of forming the touch/hook and loop component portion 102 (e.g., a hook component) integrally with the first framing member 103/second framing member 105 itself may equally be employed. In some embodiments, the first framing member 103/second framing member 105 may thereby comprise a framing member (e.g., structural) with an array of a plurality of integral hooks that form a hook component/portion 102 of a touch/hook and loop fastener system/mechanism/construct that is configured to removably couple/engage/fasten with a loop component 102 of the touch/hook and loop fastener system/mechanism/construct that is attached (or otherwise associated with) one or more wall/ceiling panels 101 (e.g., drywall panels).

As shown in FIGS. 3 and 5, a plurality of the first framing members 103 and/or second framing members 105 may be spaced at intervals (e.g., regular intervals) between a ceiling plate/header and a sole/footer plate, within a wall space, with the respective touch/hook and loop fastener component 102 facing in the direction on which one or more of the panels/sheets 101 are to be fastened to form a wall structure 150, 160. Ideally, studs or joists would extend vertically/parallel to each other with the sides connectable to the panels/sheets 101, being aligned. However, it is noted that such a uniform layout of framing members 103/105 and/or panels/sheets 101 is rarely achieved and misalignment is common (e.g., potentially most commonly in construction utilizing wood studs).

Referring to FIG. 6, wall/ceiling panel fastening systems and methods of the current disclosure may include a furring strip or like framing member. FIG. 6 illustrates an exemplary furring strip 108 for connection with another framing member (e.g., a stud), or even a panel (e.g., a sheet rock panel or the like) that does not include a touch/hook and loop component 102 on an exposed face thereof. As shown in FIG. 6, the furring strip 108 may include the touch/hook and loop component 102 on at least one outer exposed side/surface thereof. In some embodiments, the furring strip 108 may include at least one through aperture/hole 114, such as, for example, countersunk holes. In other embodiments, the furring strip 108 may be void of the apertures 114 (which may be formed by a user at the time of installation, for example).

In some embodiments, the furring strip 108 may have the touch/hook and loop component 102 at/on a front face thereof, and an opposing back face may be void of any touch/hook and loop component or may also include a touch/hook and loop component 102. In embodiments wherein the back face is void of a touch/hook and loop component 102, the at least one aperture 114 may be used with a fastener to fasten the furring strip to a framing member and/or a panel. The at least one aperture 114 may be circular or oblong (to allow movement of the fasteners passing therethrough) in cross-section, for example. In some embodiments, the front face and/or the back face may be planar faces, and the furring strip 108 may be of a constant thickness between the front and back faces.

As shown in FIG. 6, the furring strip 108 may be relatively thin along a thickness direction, and potentially of a constant thickness between its front and back faces. The furring strip 108 may thereby be configured to be positioned between two construction components to couple the components together. For example, as described further below, the back face of the furring strip 108 may abut and be coupled to a front face or side of a first construction component (e.g., a frame member or a panel) (such as via include touch/hook and loop component 102 on the back face or via fasteners extending through the furring strip from the front side through the back side and into the first construction component), and the front face of the furring strip 108 may abut and be coupled to a back face or side of a second construction component (e.g., a frame member or a panel) via include touch/hook and loop component 102 on the front face (and corresponding touch/hook and loop component 102 on the back side or face of the second construction component). A plurality of furring strips 108 may be utilized to couple the first and second construction components together in such a manner. The furring strip 108 may thereby be of a substantially uniform thickness between the front and back faces so that the first and second construction components are consistently or evenly spaced apart in the thickness direction (and thus parallel).

The touch/hook and loop component 102 may be separate and distinct from the furring strip 108 such that the touch/hook and loop component 102 is attached or coupled to the furring strip, such as attached to the front and/or back face thereof. The touch/hook and loop component 102 may be coupled to the front and/or back face of the furring strip 108 via any method, such as for example via an adhesive (e.g., a pressure sensitive adhesive or a light (e.g., UV) cured/curable adhesive), fastener(s) (e.g., screw), clip(s) or portion (s) of the furring strip 108 being separated and bent (e.g., punched) through the touch/hook and loop component 102.

In some other embodiments, the touch/hook and loop component 102 may be formed by the material of the furring strip itself such that the touch/hook and loop component 102 and the furring strip 108 itself are integral or of one-piece construction. For example, the furring strip 108 may be formed of a metal (e.g., steel or aluminum, for example) or polymer (e.g., plastic) material (polyvinyl chloride, polyethylene or polypropylene, for example) and the front and/or back face of the furring strip 108 may include the touch/ hook and loop component 102 that is formed from the metal or polymer/plastic. In some embodiments, the furring strip 108 may be formed of a thermoplastic. In some embodiment, the material of the furring strip 108 may be perforated, pulled/pushed, cut, scraped or otherwise cause to be deformed or molded at the front and/or back face, such as when the material (e.g., a polymer or metal) is at the softening or melting temperature of the material, to form the hook portion of the touch/hook and loop component 102 (or conversely the loop portion).

In operation, the furring strip 108 may be fastened to an existing framing member or panel, with the touch/hook and loop component 102 facing outward. One or more panel/sheet 101 (e.g., drywall or the like) with the mating touch/hook and loop component 102 (e.g., a loop component) may then be attached/fastened to the touch/hook and loop component 102 (e.g., a hook component) of the furring strip 108. In certain embodiments, the furring strip 108 may be fastened to a framing member (e.g., the first or second exemplary framing member 103, 105). In other embodiments, the furring strip 108 is fastened to an existing panel or other outer surface of a building structure, such as a structure formed via one or more wood panels, synthetic panels, drywall panels, cinder blocks, brick, plaster or the like. In embodiments where the furring strip 108 is connected to an existing wall, the furring strip 108 may be configured to extend from the existing wall surface, such that the touch/hook and loop component 102 faces away from the wall surface. In practice, for example, a plurality of furring strips (e.g., a plurality of furring strips 108) are attached to and disposed on a wall and/or framing member (e.g., studs), and a plurality of wall/ceiling panels/sheets 101 are connected to the furring strips through a plurality of touch fasteners 102, creating a new wall face in front of the old wall.

FIGS. 7A and 7B illustrate another exemplary furring strip 109 for connection with another framing member (e.g., a stud, header, footer or joist) that does not include a touch/hook and loop component 102. Furring strip 109 differs from exemplary furring strip 108 in that furring strip 109 is an adjustable furring strip that forms an L-shape. As shown in FIG. 7A, the furring strip 109 may comprise a front member/portion 116 and a side member/portion 115. The front member/portion 116 and a side member/portion 115 may be separate and distinct pieces or components that are coupled together, as shown in FIG. 7A. In some alternative embodiments, the front member/portion 116 and a side member/portion 115 may comprise a single integral piece or component.

In some exemplary embodiments, the front member/portion 116 may be configured (e.g., shaped and dimensioned) to be, for example, in the range of about 2 in wide by about ¾ in thick, including all ranges and subranges therein, limited only by practical considerations in the mechanical construction of front member/portion 116 and in the mechanics of the panel/sheet 101 (e.g., drywall or the like) installation. In some exemplary embodiments, the side member/portion 115 may be configured (e.g., shaped and dimensioned) to be, for example, in the range of about 4 in wide by about ¾ in thick, including all ranges and subranges therein, limited only by practical considerations in the mechanical construction of side member/portion 115 and in the mechanics of the panel/sheet 101 (e.g., drywall or the like) installation. The width, thickness, and length of the front member/portion 116 and/or the side member/portion 115 may vary with the applications and with the width 118 and thickness 117 of the framing member (e.g., the first or second framing member 103, 104) to which the adjustable furring strip 109 is attached.

As shown in FIGS. 7A and 7B, the front member 116 may include the touch/hook and loop component 102 at/on the front face and/or back outer face thereof (for example, a hook component 102). The side member 115 may be placed in contact with the framing member (e.g., the first or second framing member 103, 104) such that the width 118 face of the framing member is in contact with a width face of the side member 115. The side member 115 may have the touch/hook and loop component 102 (for example, a loop component 102) attached to the thickness side 117 for contact with the mating the touch/hook and loop component 102 of the front member 116. The side member 115 can be positioned such that the touch/hook and loop component 102 is facing out from the wall space. The adjustable furring strip 109 can be used when the framing member spacing and positioning needs to be adjusted for the creation of aligned members such that placement of a plurality of panel/sheets 101 against the aligned members result in a flat (or flatter) wall/celling surface.

As noted above, some touch/hook and loop fasters/systems/constructs may utilize a hook component 102. It is noted that different types of hook components 102 may be utilizes. For example, single hook or "J-hook" type hook components 102 may be utilized, such as for wall/vertical orientated panel/drywall 102 applications. As another example, double hook or "T-hook" type hook components 102 may be utilized, such as for ceiling/horizontal orientated panel/drywall 102 applications.

Referring to FIGS. 8A and 8B, the panel-framing fastening systems and methods of the current disclosure may include a panel and frame member fastening device. FIGS. 8A and 8B illustrate an exemplary panel and framing member fastening device 200 for connection with a framing member (e.g., a stud, header, footer, joist or the like, which may be a standard dimensional wood or metal framing member, for example) that does include a touch/hook and loop component 102. The fastening device 200 may be similar to the furring strip described above, and therefore the description above directed thereto may equally apply to the fastening device 200 and is not repeated herein for brevity sake. Like reference numerals are utilized to refer to like components or aspects.

In some embodiments, the panel and framing member fastening device 200 has two side wall, arm or end lateral sections/portions 222 connected by a medial interface or web section/portion 220, creating a C-shape or U-shape channel, as shown in FIGS. 8A and 8B. In some embodiments, the device 200 (e.g., the interface portion 220 and the first and second side wall portions 22) may be elongated along a length direction.

The interface portion 220 may extend laterally between the first and second side wall portions 222 such that the interface portion 220 and the first and second side wall portions 222 form an inner channel configured to receive and couple to at least a front face portion of a framing member 103 (or 101) therein, and as shown in FIG. 8A. The interface portion 220 may be substantially planar, and comprise an inner side and an outer side opposing the inner side in a thickness direction. The first and/or second side wall portions 222 may extend in the thickness direction from the inner side of the interface portion 220.

In some embodiments, at least the first and second side wall portions 222 and the interface portion 220 may be integral. For example, the first and second side wall portions 222 may extend integrally from the interface portion 220, and may oriented by being bent from the interface portion 220. In some embodiments, the first and second side wall portions 222 are orientated substantially perpendicular to the interface portion 220. The interface portion 220 and/or the touch fastening component 202 extend laterally to the first and second side wall portions 222, and not laterally past the first and second side wall portions 222, as shown in FIGS. 8A and 8B. In some embodiments, as also shown in FIGS. 8A and 8B, the first and second side wall portions 222 may extend in the thickness direction away from the inner side of the interface portion 200 the same distance.

The exterior outer-facing side of the interface portion 220 may include the touch/hook and loop component 102 (such as, for example, a hook component), as shown in FIGS. 8A and 8B. The touch/hook and loop component 202 may define an exposed outer face of the interface portion 220. As described above, the touch fastening component 102 of the device 200 is configured to removably couple with another touch fastening component when operatively engaged. As also noted above, the mating touch/hook and loop component 202 may be coupled to a back side of a panel. Also discussed above, the touch/hook and loop component 202 may be a separate and distinct component that is attached to the interface portion 220/device 200, or may be integral (e.g., formed from) with the interface portion 220/device 200. In some embodiments wherein the touch/hook and loop component 202 of the fastening device 200 is integral to the fastening device 200 (formed via the material of the fastening device 200), the fastening device 200 may be formed of a metal (e.g., steel or aluminum, for example) or a polymer (e.g., a plastic, such as PVC).

As also shown in FIGS. 8A and 8B, the first and second side wall portions 222 (and/or the interface portion 220 and touch/hook and loop component 202) include apertures or slots 214 that extend therethrough to the channel. The apertures or slots 214 are configured to allow the shaft portion of a fastener (e.g., a screw or nail) to extend therethrough (but not the head of the fastener, for example) and into the framing member 103 positioned within the channel between the first and second side wall portions 222. In some embodiments, the interface portion 220 and touch/hook and loop component 202 may include the apertures or slots 114.

In use, the channel opening of the fastening device 200 can be placed on a framing member (e.g., stud), for example the first framing member 103 or the second framing member 105, such that the interior surfaces/sides of the first and second side wall portions 222 engage and extend along the width sides of the framing member 103. The interior surface/side of the interface portion 220 of the fastening device 200 may be placed in engagement with (or at least in close proximity to) and extend along a thickness side of the framing member 103. The inner engagement surfaces of the first and second side wall portions 222 and the interface portion 220 may thereby be configured to engage respective surfaces of the framing member 103 when the framing member 103 is received within the inner channel. In some embodiments, the inner engagement surfaces of the first and second side wall portions 222 and the interface portion 220 may be planar.

FIG. 9 illustrates another exemplary panel and framing member fastening device 300 for coupling to a framing member (e.g., that is void of a touch/hook and loop component) to facilitate the fastening of a panel with touch/hook and loop component thereto, as described above. The fastening device 300 is substantially similar to the fastening device 300 described above, and therefore the description above directed thereto may equally apply to the fastening device 300 and is not repeated herein for brevity sake. Like reference numerals are utilized to refer to like components or aspects.

As shown in FIG. 9, fastening device 300 differs from fastening device 200 in that the mounting through holes or apertures 330 are elongated along the length direction. It is noted that the elongation of the mounting through holes 330 may allow for the movement of the fastening device 300 relative to a framing member that it is coupled to via fasteners extending through the mounting through holes 330, such as due to expansion or contraction of the framing member, the fastening device 300 and/or a panel coupled to the fastening device 300.

Figure 10A:
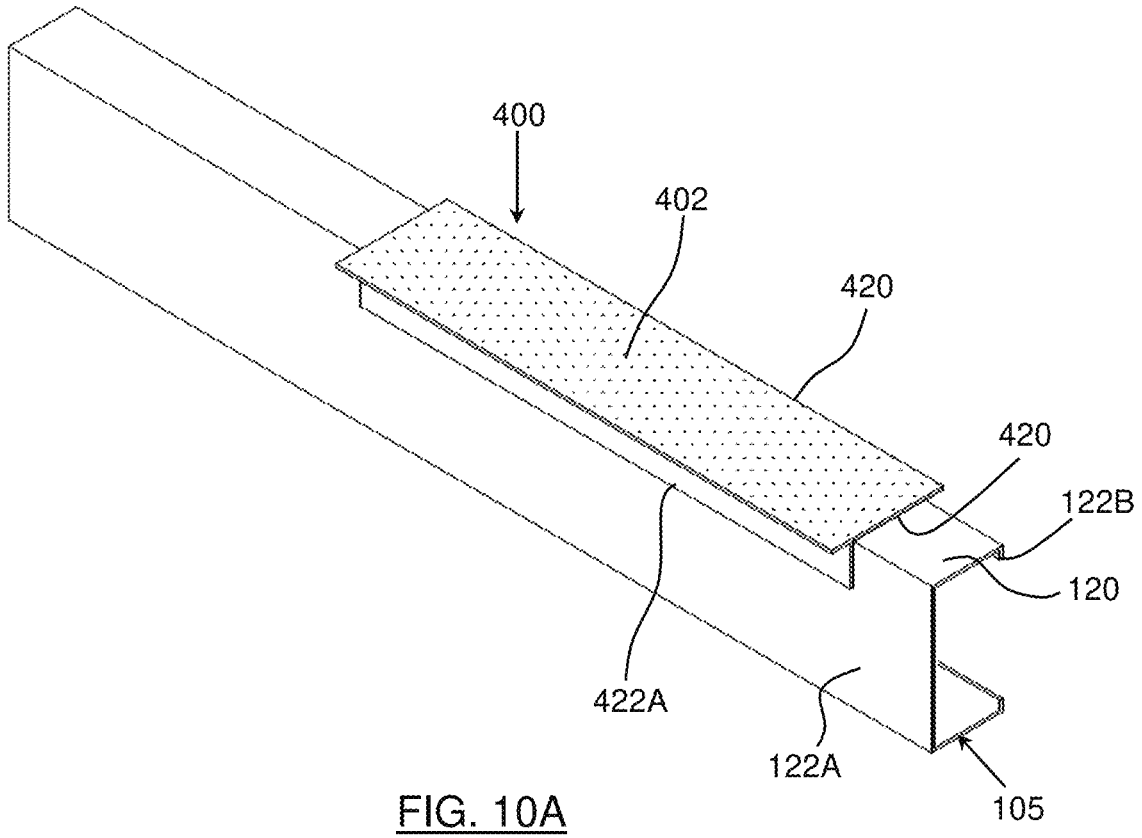
FIG. 10A is an elevational perspective view of another coupling device with a channel and a hook and a loop fastener operatively coupled to a framing member for coupling a panel thereto, in accordance with an aspect of the present disclosure.
Figure 10B:
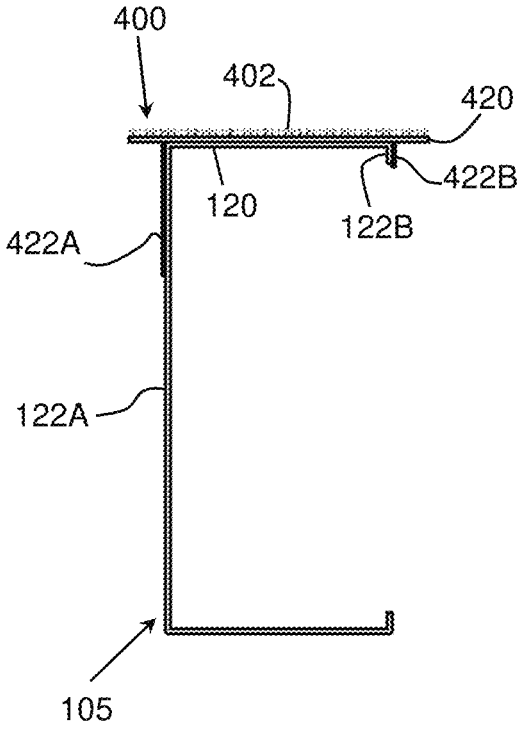
FIG. 10B is an end side view of the operatively coupled coupling device and framing member of FIG. 10A, in accordance with an aspect of the present disclosure.

FIGS. 10A and 10B illustrate another exemplary panel and framing member fastening device 400 for coupling to a framing member 105 (e.g., that is void of a touch/hook and loop component) to facilitate the fastening of a panel with touch/hook and loop component thereto, as described above. The fastening device 400 is substantially similar to the fastening device 300 and the fastening device 200 described above, and therefore the description above directed thereto may equally apply to the fastening device 400 and is not repeated herein for brevity sake. Like reference numerals are utilized to refer to like components or aspects.

As shown in FIGS. 10A and 10B, fastening device 400 differs from fastening device 300 and fastening device the 200 in that the interface portion 420 extends laterally past the first and second side wall portions 422A, 422B, and the sides or ends of the corresponding outer face 120 of the framing member 105. Further, the touch/hook and loop component at the outer side of the interface portion 420 extends laterally past the first and second side wall portions 422A, 422B.

As shown in FIG. 10B, the fastening device 400 differs from fastening device 300 and fastening device the 200 in that the first and second side wall portions 422A, 422B are not the same lengths. Rather, as shown in FIG. 10B, the first side wall portion 422A is longer that the second side wall portion 422B. As shown in FIGS. 10A and 10B, such a configuration of the first and second side wall portions 422A, 422B may be advantageous for use with a framing member 105 (e.g., a metal stud) that includes a side opening on one side thereof. With such a framing member 105, the "long" first side wall portion 422A may extend along the full solid side 122A of the framing member 105, and may be coupled thereto (e.g., via fasteners). Likewise, a the "short" second side wall portion 422B may extend along a short side or end 122B of the framing member 105. It is also noted that when used with a metal framing member 105, the device 400 may be coupled thereof via punching a portion(s) of the device 400 through a portion of the metal framing member 105, such that such portion(s) extend through at one or more angle or direction that securely couples the device 400 and metal framing member 105 together.

It is also noted that the fastening device 400 (or the fastening device 300 and/or the fastening device 200), may not include mounting through holes, and self-tapping or other fasteners may be punctured through the material of the fastening device 400 (e.g., the first and/or second side wall portions 422A, 422B) and into the framing member 105.

Figure 11A:
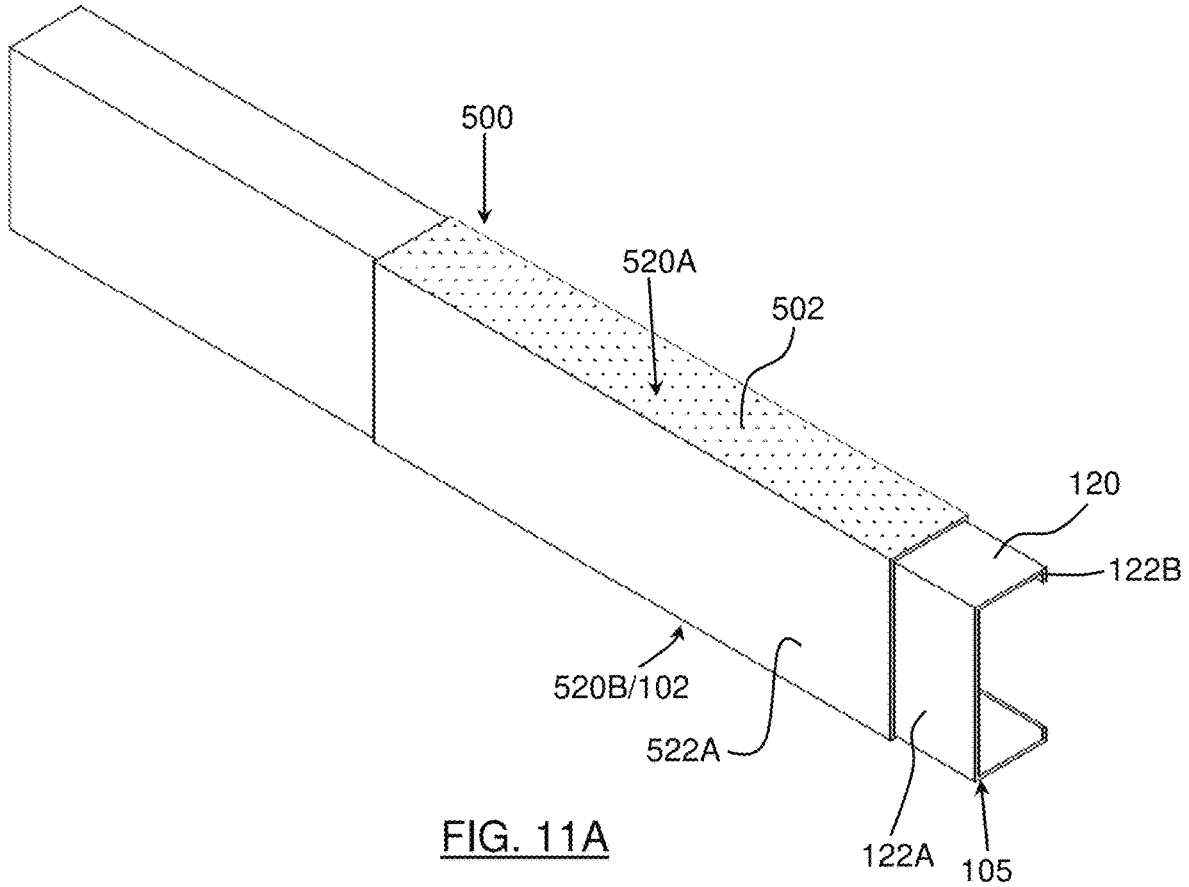
FIG. 11A is an elevational perspective view of another coupling device with a channel and a hook and a loop fastener operatively coupled to a framing member for coupling a pair of panels thereto, in accordance with an aspect of the present disclosure.
Figure 11B:
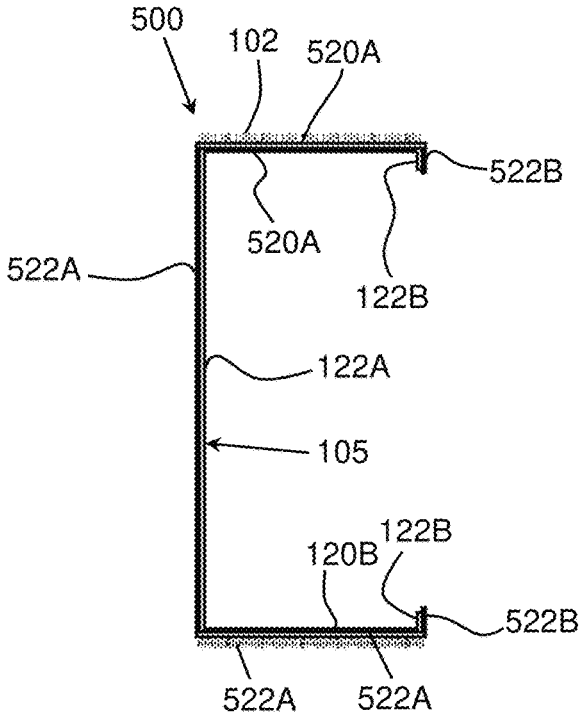
FIG. 11B is an end side view of the operatively coupled coupling device and framing member of FIG. 11A, in accordance with an aspect of the present disclosure.

FIGS. 11A and 11B illustrate another exemplary panel and framing member fastening device 500 for coupling to a framing member 105 (e.g., that is void of a touch/hook and loop component) to facilitate the fastening of a panel with touch/hook and loop component thereto, as described above.

The fastening device 500 is substantially similar to the fastening device 400, the fastening device 300, and the fastening device 200 described above, and therefore the description above directed thereto may equally apply to the fastening device 500 and is not repeated herein for brevity sake. Like reference numerals are utilized to refer to like components or aspects.

As shown in FIGS. 11A and 11B, fastening device 500 differs from fastening device 400, fastening device 300 and fastening device the 200 in that the fastening device 500 includes a second interface portion 520B spaced from the interface portion 520A in the thickness direction. The second interface portion 520B may be the same or similar to the interface portion 520A in that it comprises a second inner side and a second outer side opposing the second inner side in the thickness direction, the second outer side comprising a second touch fastening component 502 of a second touch fastener defining an exposed outer face of the second interface portion 520B that opposes the outer face of the interface portion 520A. The inner side of the interface portion 520A and the second inner side of the second interface portion 520B may face toward each other in the thickness direction.

As shown in FIGS. 11A and 11B, the first wall portion 522A may extend between the inner side of the interface portion 520A and the second inner side of the second interface portion face 520B. As also shown in FIGS. 11A and 11B, the interface portion 520A, the first side wall portion 522A and the second interface portion 520B may form an inner cavity that is configured to receive the framing member 102 therein (the entire cross-section therein) with a front face 120A of the framing member 105 engaged with the interface portion 520A, a back face 120B of the framing member 105 engaged with the second inner side of the second interface portion 520B, and an inner side of the first side wall portion 522A engaged with a side surface 122A of the framing member 102 extending between the front and back faces 120A, 120B thereof. The fastening device 500 may also include a "short" second side wall portion 522B extending from the inner side of the second interface portion 520B. As shown in FIGS. 11A and 11B the side opposite the first side wall portion 522A may have an opening that allows the framing member 105 to be positioned within the inner cavity. For example, the opening may be formed between the "short" first and second side wall portions 552A, 522B (or, alternatively, the first and second second interface portions 502A, 520B). The "short" first and second side wall portions 552A, 522B may thus terminate at locations along the thickness direction that is spaced from each other and the first and second interface portions 520A, 520B such that the opening is formed between free ends thereof, as shown in FIGS. 11A and 11B.

Figure 12A:
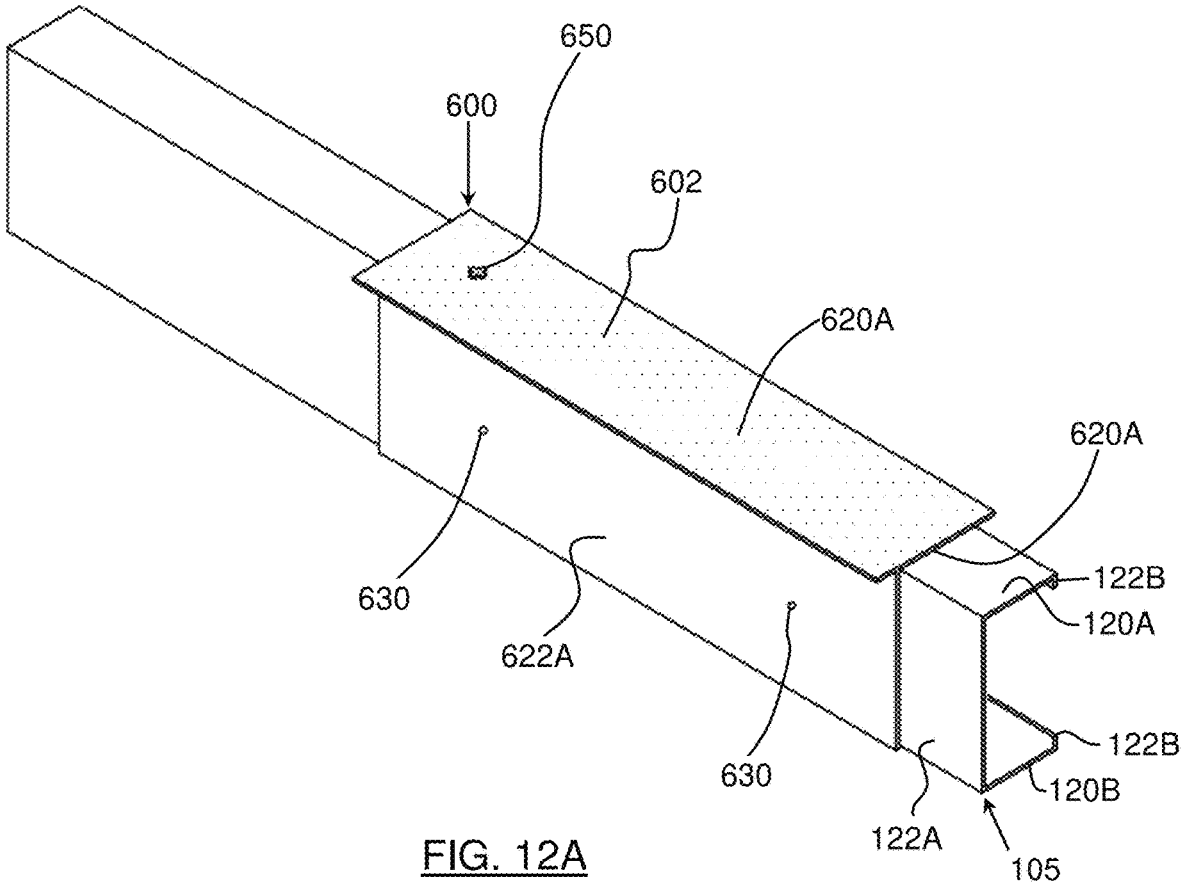
FIG. 12A is an elevational perspective view of another coupling device with a channel and a hook and a loop fastener operatively coupled to a framing member for coupling a pair of panels thereto, in accordance with an aspect of the present disclosure.
Figure 12B:
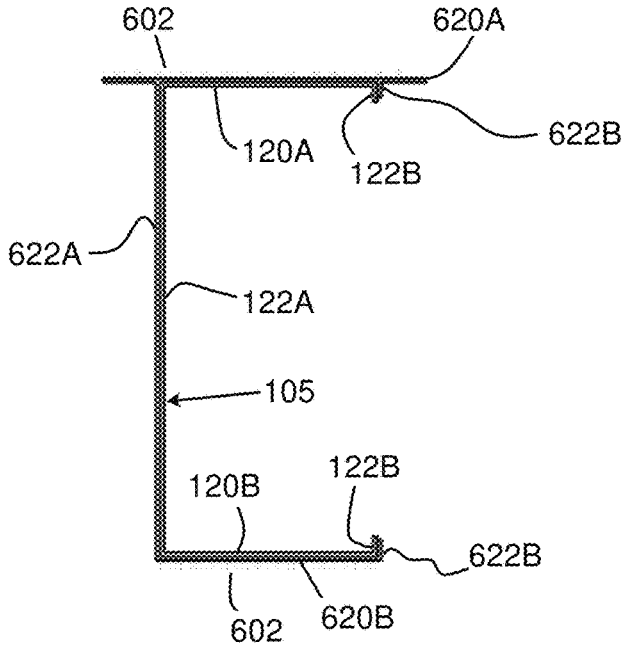
FIG. 12B is an end side view of the operatively coupled coupling device and framing member of FIG. 12A, in accordance with an aspect of the present disclosure.
Figure 13:
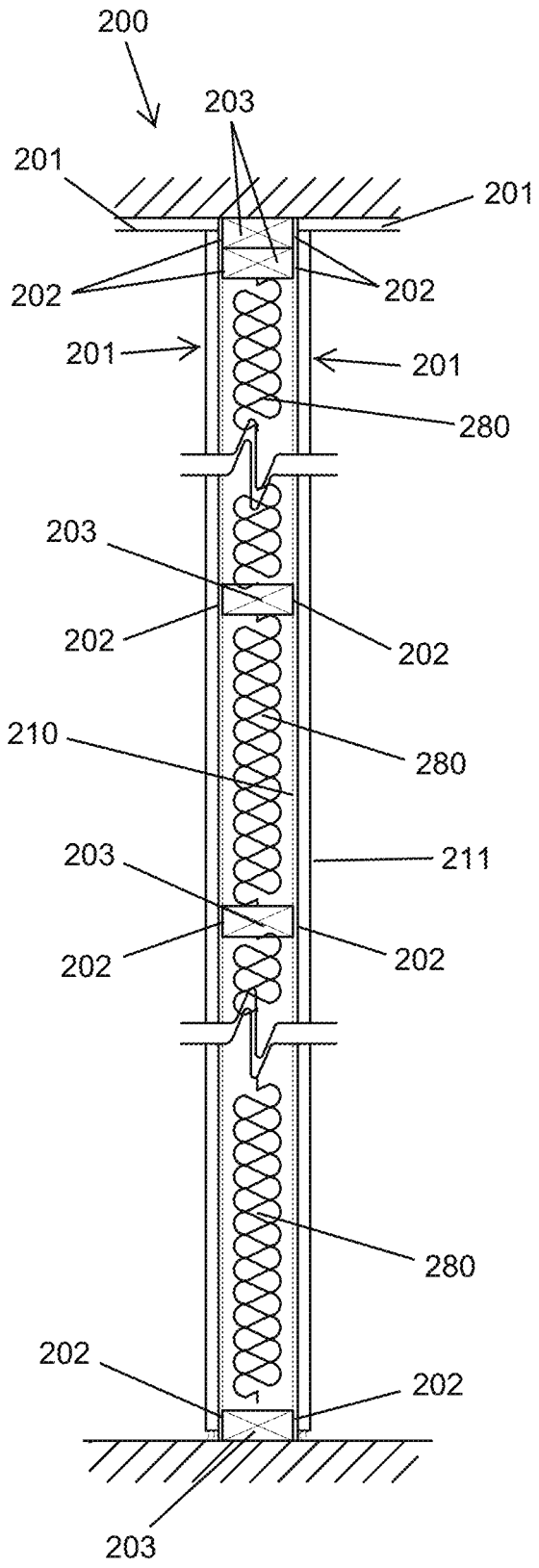
FIG. 13 is a cross-sectional view of a building structure formed with panels and framing members coupled together via the disclosed hook and a loop fastener components and systems, in accordance with an aspect of the present disclosure.
Figure 14:
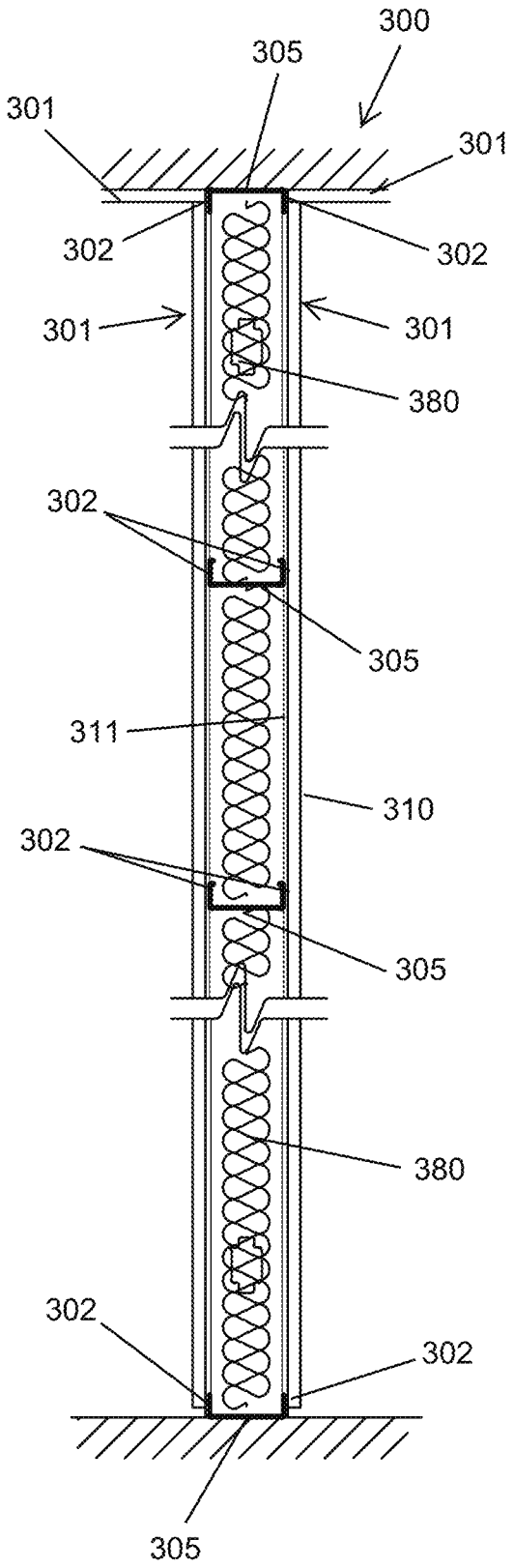
FIG. 14 is a cross-sectional view of another building structure formed with panels and framing members coupled together via the disclosed hook and a loop fastener components and systems, in accordance with an aspect of the present disclosure

FIGS. 12A and 12B illustrate another exemplary panel and framing member fastening device 600 for coupling to a framing member 105 (e.g., that is void of a touch/hook and loop component) to facilitate the fastening of a panel with touch/hook and loop component thereto, as described above. The fastening device 600 is substantially similar to the fastening device 500, fastening device 400, the fastening device 300, and the fastening device 200 described above, and therefore the description above directed thereto may equally apply to the fastening device 600 and is not repeated herein for brevity sake. Like reference numerals are utilized to refer to like components or aspects.

As shown in FIGS. 12A and 12B, fastening device 600 is substantially the same as the fastening device 500, but differs in that the first and second interface portions 502A, 520B (and touch/hook and loop component 502 thereon/thereof) define differing lateral widths. For example, the first interface portion 502A (and touch/hook and loop component 502 thereon/thereof) may define a greater lateral width than the second interface portion 502A (and touch/hook and loop component 502 thereon/thereof).

In some embodiments, the touch/hook and loop component 102 (for example, a loop component) of a touch/hook and loop fastener system/mechanism/construct is attached/coupled/connected (e.g., directly or indirectly) to the back side 110 of a wall/ceiling panel/sheet 101 (e.g., drywall or the like) through, for example, lamination, heating, or use of a chemical solvent or an adhesive. In some embodiments, the touch/hook and loop component 102 may be affixed/connected to or formed from/of another member/object, for example, the first framing member 103 (e.g., a wood stud), the second framing member 105 (e.g., a metal stud), or a fastening device that is configured to be coupled to a framing member (or is pre-coupled to a framing member). There may be other framing members, or accessories, to which a touch/hook and loop component 102 is connected or formed from/of.

As noted above, the use of a "hook" component verse a "loop" component with respect to any component is only for explanatory purposes, and the use of the "hook" component verse a "loop" component may equally be employed in a reversed orientation/arrangement. Similarly, any other style or configuration touch fastener may be equally utilized.

In some embodiments, a touch/hook and loop component 102 may have additives or layers to provided beneficial, commercially viable and needed feature properties such as, for example, moisture/water-resistance, and/or fire resistance, and/or sound dampening. Typically, it is customary and well known in the art to provide fire resistance by increasing the amount of gypsum within panel/sheet 101 (e.g., drywall or the like). Water resistance may be increased in panels/panel/sheet 101 (e.g., drywall or the like) by adding one or more water resistant layers there-within (and/or adding paper treatment to the inner surface 110 thereof, for example). Sound dampening may be achieved by using multiple sheets of panels/panel/sheet 101 (e.g., drywall or the like) to prevent or minimize vibration transmission through the panels/panel/sheet 101 (e.g., drywall or the like) and through the fasteners attaching the panels/panel/sheet 101 (e.g., drywall or the like) the framing members. Providing fire-resistance, and/or water resistance, and/or sound dampening features through the touch/hook and loop components 102 rather than the panels/panel/sheet 101 (e.g., drywall or the like) minimizes the need for using a plurality of layer of panels/panel/sheet 101 (e.g., drywall or the like) and/or such specially treated/configured panels/panel/sheet 101 (e.g., drywall or the like). The touch/hook and loop fastener system/mechanism/construct itself mitigates the need to use an additional feature component within the panels/panel/sheet 101 (e.g., drywall or the like) to achieve such moisture/water-resistance, fire resistance, and/or sound dampening.

For example, an unexpected result of the wall/ceiling panel fastening systems and methods of the current disclosure is achieved via the installation method disclosed herein using touch fasteners. Namely, when the touch/hook and loop components 102 (comprising a flexible/bendable/pliable material (plastic, fabric, plasticized fabric, metal, etc.) are installed/formed on the panels/panel/sheet 101 (e.g., drywall or the like) and the framing members supporting the panels/panel/sheet 101 (e.g., drywall or the like) (e.g., the first framing member 103 (e.g., a wood stud), the second framing member 105 (e.g., a metal stud), the panel and framing member fastening device 106, the furring strip 108, or the adjustable furring strip 109) in accordance with the disclosed systems and methods, the construct exhibits and is characterized by a highly-desired and commercially needed expansion and contraction accommodation and sound-dampening effect. This sound dampening characteristic can be measured from the touch/hook and loop fastener system/mechanism/construct itself, standing alone, however, in still other embodiments, additional sound-dampening materials or substances may be added, for example, to at least one of the touch/hook and loop components 102, to further dampen sound transmission through the panel/sheet 101 (e.g., drywall or the like).

Similarly, a fire-resistance or the moisture/water-resistance barrier may also be added to the touch/hook and loop fastener system/mechanism/construct, for example, the hook component 102 and/or the loop component 102. In addition, the touch/hook and loop fastener system/mechanism/construct may be able to amplify feature properties within a panel/sheet 101 (e.g., drywall or the like) by providing, for example, a greater water-resistance, fire-resistance and/or sound dampening.

The use of rigid fasteners, such as nails or screws, to attach a panel/sheet 101 (e.g., drywall or the like) to framing members provide for sound vibration transmission through the panel/sheet 101 (e.g., drywall or the like) and through the framing members (i.e., the walls/ceilings) to which the panel/sheet 101 (e.g., drywall or the like) is affixed. However, the use of flexible touch/hook and loop components 102 provides for sound dampening and contraction/expansion of the wall/ceiling construct, for example.

Further, tapes and adhesives may be utilized to attach a panel/sheet 101 (e.g., drywall or the like) to framing members, but neither can effectively be used as a secure fastening mode without the use of rigid fasteners (e.g., screws or nails). For example, tapes provide for poor connections on uneven surfaces and may require some cure time to effectively adhere to the surfaces to be connected. Use of glue, a solvent, or an epoxy without the use of screws or nails is also not effective because glue or epoxy requires extended cure time, making support means to maintain drywall position essential during curing. Furthermore, curing requires supporting the panel/sheet 101 (e.g., drywall or the like) sheets in a fixed position for a period of several hours to several days.

Multiple feature properties may be added to the touch/hook and loop fastener system/mechanism/construct of the present disclosure. For example, a first touch/hook and loop components 102 may include one feature property and the mating second touch/hook and loop components 102 may include a second feature property. A touch/hook and loop fastener system/mechanism/construct may include, for example, a hook component 102 with a fire-resistance barrier and a loop component 102 with a water-resistance barrier.

One exemplary method for installing a wall-ceiling panel/sheet 101 (e.g., drywall or the like) with a fastening system of the present disclosure may be performed as follows. A plurality of wall-ceiling panels/sheets 101 comprising the first fastening component 102 of the touch fastener configured to be operable with the second fastening component 102 of the touch fastener on a framing member (e.g., a joist and/or stud) is provided. The framing members are installed as required by building specification or standard construction requirements, such that the second touch fastening component 102 faces the panels/drywalls sheets 101 that are to be affixed. It is noted that the framing member may themselves form the second touch fastening component 102, the second touch fastening component 102 may be directly coupled thereto, or a fastening device comprising the second touch fastening component 102 may be coupled thereto. A panel/sheet 101 (e.g., drywall or the like) is placed such that the first fastening component 102 is before the second fastening component 102 and a width of the panel/sheet 101 (e.g., drywall or the like) is aligned with the level. The panel/sheet 101 (e.g., drywall or the like) is then pressed against the framing member such that the first fastening component 102 and the second fastening component 102 are engaged, fastening the panel/sheet 101 (e.g., drywall or the like) to the framing member(s). A plurality of panel/sheets 101 may be, for example, adjacently placed and connected in such a manner to framing members form a wall or ceiling surface, for example.

In some embodiments, the method may include attaching the first fastening component 102 of the touch fastener to the panels/sheets 101, such as adhering, gluing, pressing, rolling or otherwise securely affixing the first fastening component 102 to the back side 110 of the panels/sheets 101. In some embodiments, the method may include attaching the second fastening component 102 of the touch fastener to the framing members, such as adhering, gluing, pressing, rolling or otherwise securely affixing the second fastening component 102 to one or more exposed surfaces of the framing members. In some other embodiments, the method may include forming the second fastening component 102 of the touch fastener from the framing member (i.e., an integral fastening component, such an array of hook members as a hook component). For example, in some such embodiments the method may include obtaining a framing member (such as, but not limited to, a metal or polymer stud, c-channel, furring strip or the other support framing member) and forming an array of a plurality of hook members as a hook component of a touch/hook and loop fastener system/mechanism/construct that is configured to removably couple with a loop, hook or other component of the touch/hook and loop fastener system/mechanism/construct. In some such embodiments, the formation of the array of a plurality of hook members may comprise working the framing member with a perforated roller die. In some other embodiments, the method may include attaching a fastening member comprising the second fastening component 102 of the touch fastener to the framing members, such as nailing or screwing the fastening device to o one or more exposed surfaces of the framing members. As noted above, in some embodiments the framing members may comprise the first framing member 103 (e.g., a wood stud), the second framing member 105 (e.g., a metal stud), and may comprise a separate component/device that forms or otherwise includes the second fastening component 102 coupled thereto.

The wall/ceiling panel fastening systems and methods of the current disclosure provide for wall/ceiling constructs void of screws or nails (or the like) for connecting the panels/panel/sheet 101 (e.g., drywall or the like) to the framing members. By minimizing or eliminating the need for using screws or nails (or the like) to attach the panels/panel/sheet 101 (e.g., drywall or the like) to the framing members, the installation is faster, because touch fasteners may be mounted and installed by aligning the panel/sheet 101 (e.g., drywall or the like) and pressing the panel/sheet 101 (e.g., drywall or the like) towards the framing member (s) to engage the touch fastener 102. The need to screw in screws or hammer in nails to support the panel/sheet 101 (e.g., drywall or the like) is minimized or eliminated, thus reducing installation time.

In an environment where existing studs or other framing members are present but there is no second touch/hook and loop fastening component 102 thereon, the panel and framing member fastening device 106, or the furring strip 108, or the adjustable furring strip 109, may be connected to the studs or other framing members to create a surface with the second fastening component 102 facing out from the wall. The panels/sheets 101 may then be aligned so that the first fastening component 102 attached thereto and the second fastening component 102 studs or other framing members are engaged. The plurality of panels/sheets 101 can be, for example, adjacently placed and connected in such a manner form a wall/ceiling surface via the studs or other framing members.

In an environment where there is an existing plaster, or brick, or cinder-block wall, for example, the furring strip 108 may be attached (e.g., screwed) to the wall, such that the side with the second fastening component 102 thereof faces out from the wall. The inner side 110 of the panels/sheets 101 with the first fastening component 102 (e.g., a loop component) may be aligned with and engaged with the second fastening component 102 (e.g., a hook component) of the furring strips 108. A plurality of panels/sheets 101 may be placed adjacent to one another to form a wall surface via the furring strips 108.

It is noted that the panels/sheets 101 may be installed horizontally or vertically. For example, a level thereof can be adjusted to account for the width or height of the panel/sheet 101 (e.g., drywall or the like) and the wall height/width.

In some embodiments, the panels/sheets 101 may include a first fastening component 102 of a touch/hook and loop fastener system/mechanism/construct on the back side 110 of the panel/sheet 101 (e.g., drywall or the like) and a second fastening component 102 of the on the touch/hook and loop fastener system/mechanism/construct on the front side 111 of the panel/sheet 101 (e.g., drywall or the like). By connecting a plurality of such panels/sheets 101 front side 111 to back side 110 thereof (and with the plurality of panels/sheets 101 being substantially parallel to each other) the first fastening component 102 and the second fastening component 102 become operatively engaged to removably securely couple the panels/sheets 101—creating a stack of panels/sheets 101. The stack of the plurality of panels/sheets 101 may exhibit multiple properties, or a single property may be amplified. For example, such a stack of a plurality of panels/sheets 101 may provide a high level of soundproofing (such as for a movie theater or any other application where sound damping/proofing is desirable).

It is further noted that the wall/ceiling panel fastening systems and methods of the current disclosure provide for the removal of the panels/sheets 101 from the framing members without damaging the framing members. For example, panels/sheets 101 may be, for example, pulled away from the framing members such that the touch fastening components 102 of the touch/hook and loop fastener system/mechanism/construct are separated or disengaged from each other. Thereafter, new panel/sheet 101 (e.g., drywall or the like) with new a touch fastening component 102 may then be operatively coupled to the touch fastening component 102 of the framing member(s) to replace the old panel/sheet 101 (e.g., drywall or the like) and reform the wall/ceiling structure.

While the terms "wall member" and "wall" are used, panels may also be used as a ceiling and/or floor material, partition material, or for any other building structure. The use of the terms wall member and wall shall also be understood to include ceiling member and ceiling, and floor member and floor, or any other building member within a wall space, ceiling space, or floor space, or other building structure. The embodiments shown in FIGS. 1-13 may specifically be used in/as ceiling and/or floor construction. These embodiments are described in regard to wall use, however one skilled in the art would understand that these apparatuses, devices, systems, and methods may be used with ceilings and floors.

While standard measurements are provided for accessories, framing members and wall/ceiling covering panels (e.g., drywall), such may equally be employed/configured with non-standard or differing measurements.

It is to be understood that the above description is intended to be illustrative, and not restrictive. For example, the above-described examples (and/or aspects thereof) may be used in combination with each other. In addition, many modifications may be made to adapt a particular situation or material to the teachings of the various examples without departing from their scope. While dimensions and types of materials may be described herein, they are intended to define parameters of some of the various examples, and they are by no means limiting to all examples and are merely exemplary. Many other examples will be apparent to those of skill in the art upon reviewing the above description. The scope of the various examples should, therefore, be determined with reference to the claims included herein, along with the full scope of equivalents to which such claims are entitled.

As used herein, the terms "including" and "in which" are used as the plain-English equivalents of the respective terms "comprising" and "wherein." Moreover, as used herein, the terms "first," "second," and "third," etc. are used merely as referee labels, and are not intended to impose numerical, structural or other requirements on their objects. Forms of term "based on" herein encompass relationships where an element is partially based on as well as relationships where an element is entirely based on. Forms of the term "defined" encompass relationships where an element is partially defined as well as relationships where an element is entirely defined. Further, the limitations of the claims included herein are not written in means-plus-function format and are not intended to be interpreted based on 35 U.S.C. § 112, sixth paragraph, unless and until such claim limitations expressly use the phrase "means for" followed by a statement of function cavity of further structure. It is to be understood that not necessarily all such objects or advantages described above may be achieved in accordance with any particular example. Thus, for example, those skilled in the art will recognize that the devices, systems and methods described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of examples, it should be readily understood that the disclosure is not limited to such disclosed examples. Rather, this disclosure can be modified to incorporate any number of variations, alterations, substitutions or equivalent arrangements not heretofore described, but which are commensurate with the spirit and scope of the disclosure. Additionally, while various examples have been described, it is to be understood that aspects of the disclosure may include only one example or some of the described examples. Also, while some disclosure are described as having a certain number of elements, it will be understood that the examples can be practiced with less than or greater than the certain number of elements.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

The invention claimed is:

1. A framing and panel fastening device, comprising:

a first interface portion that is substantially planar and comprises a first inner side and a first outer side opposing the first inner side in a thickness direction, the first outer side comprising a first touch fastening component of a first touch fastener defining an exposed outer face of the first interface portion, the first touch fastening component of the first touch fastener configured to removably couple with a second touch fastening component of the first touch fastener when operatively engaged therewith;

a second interface portion that is substantially planar and spaced from the first inner side of the first interface portion in the thickness direction, the second interface portion comprising a second inner side and a second outer side opposing the second inner side in the thickness direction, the second outer side comprising a first touch fastening component of a second touch fastener defining an exposed outer face of the second interface portion that opposes the exposed outer face of the first interface portion, the first touch fastening component of the second touch fastener configured to removably couple with a second touch fastening component of the second touch fastener when operatively engaged therewith, wherein the first inner side of the first interface portion and the second inner side of the second interface portion face toward each other in the thickness direction;

a first side wall portion extending in the thickness direction between the first inner side of the first interface portion the second inner side of the second interface portion;

a second side wall portion being spaced from the first side wall portion in a lateral direction and extending in the thickness direction from the first inner side of the first interface portion; and a third side wall portion being spaced from the first side wall portion in the lateral direction and extending in the thickness direction from the second inner side of the second interface portion, wherein the second side wall portion terminates at a location along the thickness direction and the third side wall portion terminates at a location along the thickness direction such that free ends of the first and third side wall portions form an opening therebetween extending along the thickness direction, wherein the first inner side of the first interface portion, the second inner side of the second interface portion, and inner sides of the first, second and third side wall portions form an inner cavity that is configured to receive and couple to a building structure framing member therein with a front face of the building structure framing member abutting the first inner side of the first interface portion, a back face of the building structure framing member abutting the second inner side of the second interface portion, the inner side of the first side wall portion being planar and abutting a first lateral side of the building structure framing member that extends between the front and back faces in the thickness direction, the inner side of the second side wall portion abutting a front portion of a second lateral side of the building structure framing member that extends between the front and back faces in the thickness direction, and the inner side of the third side wall portion abutting a back portion of the second lateral side of the building structure framing member, wherein the first inner side of the first interface portion and the inner sides of the first and second side wall portions form a first inner channel of the inner cavity configured to receive, abut and couple to a front face portion of the building structure framing member comprising the front face of the building structure framing member therein, wherein the second inner side of the second interface portion and the inner sides of the first and third side wall portions form a second inner channel of the inner cavity configured to receive, abut and couple a rear face portion of the building structure framing member comprising the rear face of the building structure framing member therein, and wherein the first and second interface portions and the first, second and third side wall portions are elongated along a length direction.

2. The framing and panel fastening device of claim 1, wherein the first touch fastener comprises a hook and loop fastener, the first touch fastening component of the first touch fastener comprising a loop component or a hook component of the hook and loop fastener, and the second touch fastening component of the first touch fastener comprising the other of the loop component or the hook component of the first hook and loop fastener, and wherein the second touch fastener comprises a hook and loop fastener, the first touch fastening component of the second touch fastener comprising a loop component or a hook component of the hook and loop fastener, and the second touch fastening component of the second touch fastener comprising the other of the loop component or the hook component of the first hook and loop fastener.

3. The framing and panel fastening device of claim 1, wherein the inner side of the first side wall portion is a first inner planar engagement surface that extends fully between the first inner side of the first interface portion and the second inner side of the second interface portion.

4. The framing and panel fastening device of claim 1, wherein the first side wall portion, the second side wall portion, the first interface portion, and the second interface portion are integral.

5. The framing and panel fastening device of claim 1, wherein the first interface portion and the first touch fastening component of the first touch fastener are integral such that the first touch fastening component of the first touch fastener is formed via the material of the first interface portion.

6. The framing and panel fastening device of claim 5, wherein the first interface portion is formed of a metal material or a polymer material.

7. The framing and panel fastening device of claim 1, wherein the first and second side wall portions are orientated substantially perpendicular to the first inner side of the first interface portion, and the first and third side wall portions are orientated substantially perpendicular to the second inner side of the second interface portion.

8. The framing and panel fastening device of claim 1, wherein at least the the first side wall portion includes at least one mounting through hole extending therethrough from an outer side thereof to the inner cavity, the at least one mounting through hole being configured to receive a fastening member therethrough to couple the framing and panel fastening device and the building structure framing member together.

9. The framing and panel fastening device of claim 8, wherein the at least one mounting through hole is elongated along the length direction.

10. The framing and panel fastening device of claim 1, wherein the building structure framing member is a dimensional framing stud, header, footer or joist formed of wood or metal, and the inner cavity is configured to receive, abut and couple to the framing stud, header, footer or joist.

11. The framing and panel fastening device of claim 1, wherein the first interface portion and the first touch fastening component of the first touch fastener extend laterally past outer sides of the first and second side wall portions.

12. The framing and panel fastening device of claim 11, wherein the second interface portion and the first touch fastening component of the second touch fastener terminates at outer sides of the first and third side wall portions.

13. The framing and panel fastening device of claim 1, wherein the inner side of the second side wall portion is an inner planar engagement surface that extends fully between the first inner side of the first interface portion and the free end of the second side wall portion, and the inner side of the third side wall portion is an inner planar engagement surface that extends fully between the second inner side of the second interface portion and the free end of the third side wall portion.

14. The framing and panel fastening device of claim 1, wherein the second interface portion and the first touch fastening component of the second touch fastener are integral such that the first touch fastening component of the second touch fastener is formed via the material of the second interface portion.

15. The framing and panel fastening device of claim 14, wherein the second interface portion is formed of a metal material or a polymer material.

16. The framing and panel fastening device of claim 1, wherein the second and third side wall portions are aligned along the lateral direction.

17. A method of fastening a building panel to one or more framing members, comprising:

obtaining or providing at least one framing and panel fastening device, comprising:

a first interface portion that is substantially planar and comprises a first inner side and a first outer side opposing the first inner side in a thickness direction, the first outer side comprising a first touch fastening component of a first touch fastener defining an exposed outer face of the first interface portion, the first touch fastening component of the first touch fastener configured to removably couple with a second touch fastening component of the first touch fastener when operatively engaged therewith;

a second interface portion that is substantially planar and spaced from the first inner side of the first interface portion in the thickness direction, the second interface portion comprising a second inner side and a second outer side opposing the second inner side in the thickness direction, the second outer side comprising a first touch fastening component of a second touch fastener defining an exposed outer face of the second interface portion that opposes the exposed outer face of the first interface portion, the first touch fastening component of the second touch fastener configured to removably couple with a second touch fastening component of the second touch fastener when operatively engaged therewith, wherein the first inner side of the first interface portion and the second inner side of the second interface portion face toward each other in the thickness direction;

a first side wall portion extending in the thickness direction between the first inner side of the first interface portion the second inner side of the second interface portion;

a second side wall portion being spaced from the first side wall portion in a lateral direction and extending in the thickness direction from the first inner side of the first interface portion; and a third side wall portion being spaced from the first side wall portion in the lateral direction and extending in the thickness direction from the second inner side of the second interface portion, wherein the second side wall portion terminates at a location along the thickness direction and the third side wall portion terminates at a location along the thickness direction such that free ends of the first and third side wall portions form an opening therebetween extending along the thickness direction, wherein the first inner side of the first interface portion, the second inner side of the second interface portion, and inner sides of the first, second and third side wall portions form an inner cavity, and wherein the first and second interface portions and the first, second and third side wall portions are elongated along a length direction;

coupling the at least one framing and panel fastening device to a building structure framing member, comprising installing the at least one framing and panel fastening device on the the building structure framing member such that the building structure framing member is received within the inner cavity with a front face of the building structure framing member abutting the first inner side of the first interface portion, a back face of the building structure framing member abutting the second inner side of the second interface portion, the inner side of the first side wall portion being planar and abutting a first lateral side of the building structure framing member that extends between the front and back faces in the thickness direction, the inner side of the second side wall portion abutting a front portion of a second lateral side of the building structure framing member that extends between the front and back faces in the thickness direction, and the inner side of the third side wall portion abutting a back portion of the second lateral side of the building structure framing member;

obtaining at least one first building panel having a front side and a back side including the second touch fastening component of the first touch fastener or the second touch fastener coupled thereto; and disposing the at least one first building panel in relation to the at least one framing and panel fastening device such that the first touch fastening component and the second touch fastener of the at least one first building panel are operatively engaged to fasten the least one first building panel and the building structure framing member together.

18. The method of claim 17, wherein coupling the at least one framing and panel fastening device to the building structure framing member comprises fastening the at least one framing and panel fastening device to the building structure framing member via at least one screw or nail that passes through the first side wall portion and into the building structure framing member.

19. The method of claim 17, further comprising:

obtaining at least one second building panel having a front side and a back side including the second touch fastening component of the other of the first touch fastener or the second touch fastener as the at least one first building panel coupled thereto, and disposing the at least one second building panel in relation to the at least one framing and panel fastening device such that the first touch fastening component and the second touch fastener of the at least one second building panel are operatively engaged to fasten the at least one second building panel and the building structure framing member together.

20. A system for paneling a framework, comprising:

at least one framing and panel fastening device, comprising at least one of the framing and panel fastening devices of claim 1; and at least one building panel having a front side and a back side including the second touch fastening component of the first tough fastener and the second touch fastening component of the second tough fastener coupled thereto.

* * * * *